US007727021B2

(12) United States Patent
Haruna et al.

(10) Patent No.: US 7,727,021 B2
(45) Date of Patent: Jun. 1, 2010

(54) CONNECTOR HAVING A PLUG, A SOCKET, AND A TUBULAR SHIELD MEMBER WITH AN ELASTIC ARM

(75) Inventors: Tomoyuki Haruna, Okayama (JP); Motoyuki Tomizu, Okayama (JP); Junichiro Kumagai, Okayama (JP); Kazuki Hayashi, Okayama (JP); Taijiro Fujiwara, Okayama (JP); Norihiro Otsu, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 12/421,484

(22) Filed: Apr. 9, 2009

(65) Prior Publication Data

US 2009/0269981 A1 Oct. 29, 2009

(30) Foreign Application Priority Data

Apr. 25, 2008 (JP) ..... 2008-115614

(51) Int. Cl.
*H01R 9/03* (2006.01)

(52) U.S. Cl. ..... 439/607.5; 439/607.41

(58) Field of Classification Search ..... 439/607.4, 439/607.41–607.52, 585
See application file for complete search history.

(56) References Cited

U.S. PATENT DOCUMENTS 2,755,331 A * 7/1956 Melcher ..... 174/87
3,144,292 A * 8/1964 Forney, Jr. ..... 439/607.52
3,219,961 A * 11/1965 Bailey et al. ..... 439/354
3,408,610 A * 10/1968 Clarkson ..... 439/18
3,439,294 A * 4/1969 Flanagan et al. ..... 333/33
3,670,293 A * 6/1972 Garver ..... 439/585
3,721,939 A * 3/1973 Paugh ..... 439/354
4,307,926 A * 12/1981 Smith ..... 439/607.52
4,310,213 A * 1/1982 Fetterolf et al. ..... 439/320
4,316,647 A * 2/1982 Bailey et al. ..... 439/354
4,361,375 A * 11/1982 Bailey et al. ..... 439/357
4,493,525 A * 1/1985 Hall et al. ..... 439/607.47
4,634,208 A * 1/1987 Hall et al. ..... 439/607.51

(Continued)

FOREIGN PATENT DOCUMENTS

JP 2001-052821 A 2/2001

(Continued)

*Primary Examiner*—Michael C Zarroli
*Assistant Examiner*—Vladimir Imas
(74) *Attorney, Agent, or Firm*—Osha • Liang LLP

(57) ABSTRACT

A connector has a plug connected to a first electric cable, and having a pin terminal and a plug holder, a socket connected to a second electric cable, and having a socket terminal and a socket holder, and a first tubular shield member and a second tubular shield member. The pin terminal of the plug is press-fitted and electrically connected to the socket terminal of the socket. The plug holder is connected to the socket holder. A first end of the first tubular shield member is electrically connected to a shield wire of the first electric cable. An elastic arm formed at an opening edge at a second end of the first tubular shield member is contacted to a conductive inner peripheral surface of the plug holder. A first end of the second tubular shield member is electrically connected to a shield wire of the second electric cable. An elastic arm of formed at an opening edge a second end of the second tubular shield member is contacted to a conductive inner peripheral surface of the socket holder.

19 Claims, 28 Drawing Sheets

U.S. PATENT DOCUMENTS 4,985,002 A * 1/1991 Maisch et al. ..... 439/607.01
4,995,836 A * 2/1991 Toramoto ..... 439/675
5,149,283 A * 9/1992 Nakazawa ..... 439/607.58
5,180,316 A * 1/1993 Miller et al. ..... 439/607.5
5,263,877 A * 11/1993 Mitani ..... 439/585
5,380,224 A * 1/1995 DiCicco ..... 439/607.5
5,683,270 A * 11/1997 Warislohner ..... 439/607.41
6,280,229 B1 * 8/2001 Harting et al. ..... 439/393
6,857,902 B2 * 2/2005 Mehnert et al. ..... 439/579
6,994,579 B2 * 2/2006 Yokoigawa et al. ..... 439/320
7,101,223 B2 * 9/2006 Neumann et al. ..... 439/585
7,575,459 B2 * 8/2009 Nickol ..... 439/314
2005/0221670 A1 * 10/2005 Neumann et al. ..... 439/585
2006/0178047 A1 * 8/2006 Croan ..... 439/578

FOREIGN PATENT DOCUMENTS

JP 2002-237348 A 8/2002

* cited by examiner

CONNECTOR HAVING A PLUG, A SOCKET, AND A TUBULAR SHIELD MEMBER WITH AN ELASTIC ARM

BACKGROUND OF THE INVENTION

1. Technical Field

The present invention relates to connectors, and in particular, to a connector having a shield function for shielding the entering of external signals.

2. Related Art

Conventionally, a screw-type connector (see Japanese Unexamined Patent Publication No. 2002-237348) for electrically connecting electric cables on the same axis center by way of a screw has been known for a connector, but the screw-type connector may loosen when microscopic vibration and the like is applied, and torque management is always necessary, whereby maintenance becomes troublesome.

A so-called bayonet-type connector (see Japanese Unexamined Patent Publication No. 2001-52821) has been known as a connector for resolving such a drawback.

SUMMARY

However, in both connectors described above, an external signal may enter the electric cable from the connector, and thus an electrical device connected to the relevant electric cable may malfunction.

The present invention has been devised to solve the problems described above, and an object thereof is to provide a connector capable of preventing entering of external signals and preventing malfunctioning of the electrical device.

In accordance with one aspect of the present invention, to solve the above problems, a connector according to the present invention relates to a connector for contacting and electrically connecting a pin terminal of a plug connected to one electric cable to a socket terminal of a socket connected with another electric cable, and for connecting a plug holder of the plug and a socket holder of the socket; wherein one end is electrically connected to a shield wire of the one electric cable and an elastic arm of a tubular shield member formed at an opening edge on another end side is contacted to an inner peripheral surface of the plug holder having conductivity; and one end is electrically connected to a shield wire of the another electric cable and an elastic arm of another tubular shield member formed at an opening edge on the other end side is contacted to an inner peripheral surface of the socket holder having conductivity.

According to the present invention, the plug holder and the socket holder are not only mechanically connected, but are electrically connected to the electric cable by way of the tubular shield member, so that the shield wire of one electric cable and the shield wire of the other electric cable are connected for electromagnetic shield.

Since the elastic arm of the tubular shield member is contacted to the inner peripheral surface of the plug holder and the socket holder, the variation in component tolerance can be absorbed, high assembly accuracy is not required, and the assembly is facilitated.

Furthermore, since the elastic arm constantly maintains a stable contact state even if vibration and the like are applied, a connector having high contact reliability can be obtained.

In an embodiment of the present invention, a portion of the inner peripheral surface of the socket holder to which the elastic arm of the tubular shield member contacts may have a surface shape that produces a click feeling.

According to such an embodiment, the click feeling is obtained when the socket holder is turned, and thus the contact state can be checked and the contact reliability further increases.

In another embodiment of the present invention, at least one straight elastic arm may extend substantially parallel along an axis center direction at the opening edge on the other end side of the tubular shield member.

According to the present embodiment, the elastic arm can be cut out along the axis center direction, and thus a tubular shield member that is easy to manufacture is obtained.

In still another embodiment of the present invention, the elastic arm of the tubular shield member may have a substantially L-shape, or a discontinuous square frame shape with one portion cutout.

According to the present embodiment, the elastic arm becomes long, whereby the desired spring force is easy to obtain, fatigue failure is less likely to occur, and a connector having a long lifespan is obtained.

In yet another embodiment of the present invention, the tubular shield member may have a joint for electrically connecting to the shield wire of the electric cable extending from the opening edge on one end side. In particular, the joint of the tubular shield member may be a caulking portion.

According to the present embodiment, the tubular shield member is reliably electrically connected to the shield wire of the electric cable by way of the caulking portion serving as the joint, whereby the connection reliability increases.

DETAILED DESCRIPTION

Embodiments of a connection structure according to the present invention will be described with reference to the accompanying drawings FIGS. 1A to 28D.

As shown in FIGS. 1A to 11D, a first embodiment is a case applied to a connector including a bayonet-type plug 10 and a socket 60.

Figure 1A:
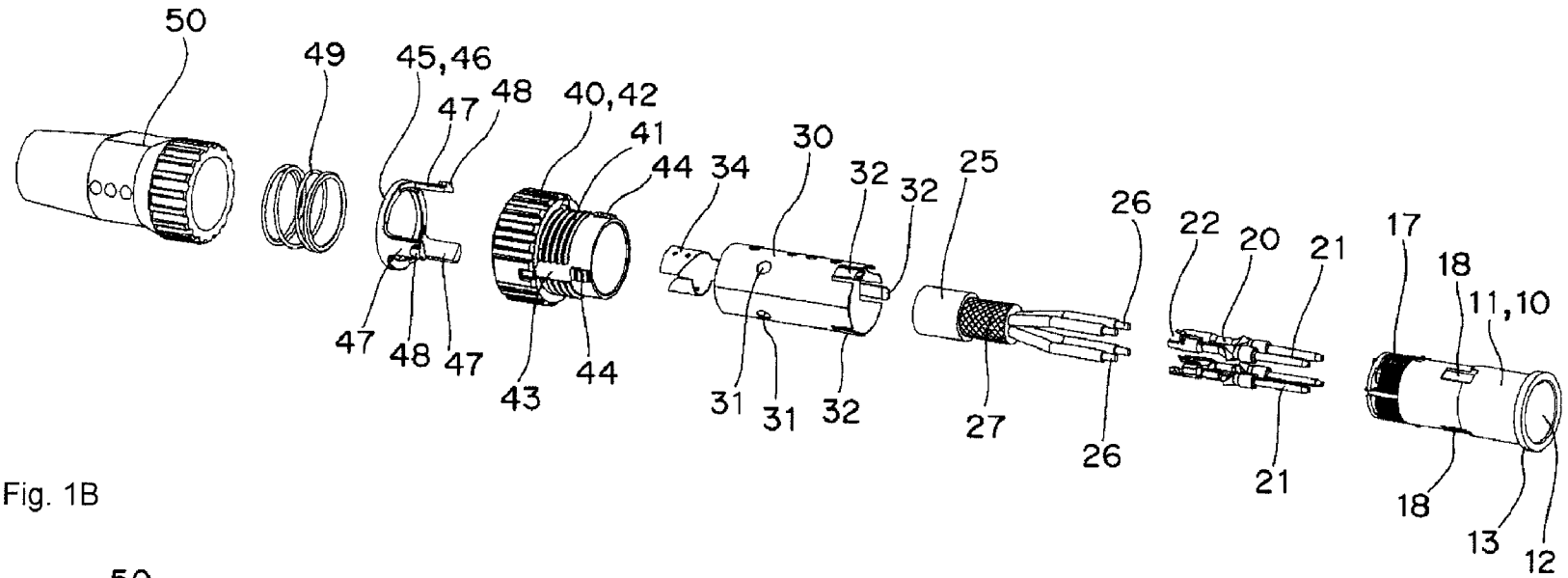
FIGS. 1A and 1B are an exploded perspective view and an exploded cross-sectional perspective view, respectively, showing a first embodiment of a plug according to the present invention.
Figure 1B:
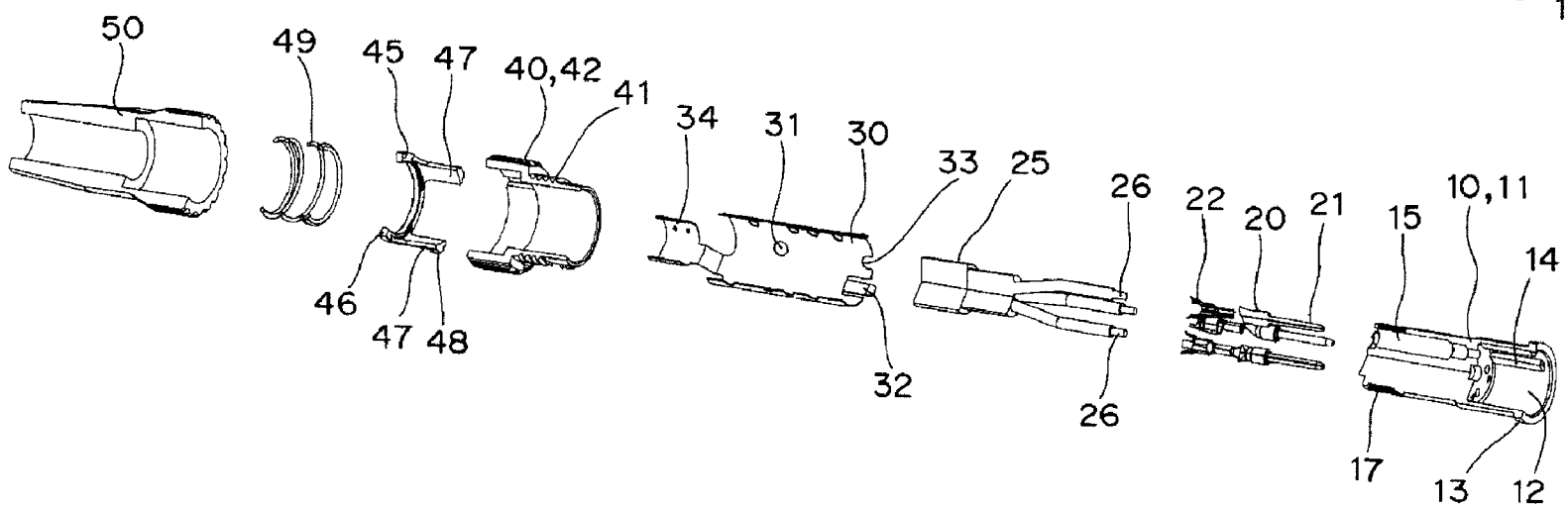

As shown in FIGS. 1A and 1B, the bayonet-type plug 10 includes a plug main body 11, four pin terminals 20, an electric cable 25, a shield member 30 also functioning as a reinforcement member, a plug holder 40, a slip-out preventing member 45, a coil spring 49, and a plug housing 50.

The plug main body 11 is a columnar resin molded article, where an annular rib 13 for preventing slip-out of the plug holder 40, to be hereinafter described, is arranged at an opening edge of a fit-in recessed site 12 arranged at one end face side. A guide protrusion 14 is arranged in a projection manner to lie along the axis core direction at the inner peripheral surface of the fit-in recessed site 12. At the other end face side of the plug main body 11, four terminal holes 15 communicating to the fit-in recessed site 12 are formed. Furthermore, a great number of annular projections 17 for increasing the contacting area with the plug housing 50, to be hereinafter described, and preventing dropping are formed at the side edge on the other end face of the outer peripheral surface of the plug main body 11. A fit-in recessed portion 18 is formed at a predetermined pitch at substantially the center of the outer peripheral surface of the plug main body 11.

The pin terminal 20 is, at one end side, arranged with a pin 21 that can be inserted to a socket portion 71 of the socket terminal 70, to be hereinafter described, and at the other end side, arranged with a joint 22 that can electrically connect a lead wire 26 of the electric cable 25, to be hereinafter described.

The electric cable 25 covers four lead wires 26 with resin, and is covered with aluminum foil (not shown) and net-like shield wire 27. The lead wire 26 is electrically connected to the joint 22 of the pin terminal 20 by pressure bonding and/or soldering.

The shield member 30 has a tubular shape made of conductive material that can be fitted into the plug main body 11, where a through-hole 31 through which the resin can pass in resin molding is appropriately formed. The shield member 30 has the opening edge on one end side cut out to form an elastic arm 32 at a predetermined pitch and is arranged with a positioning recessed portion 33, and furthermore, has a caulking portion 34 serving as a joint extending from the opening edge on the other end side.

The shield member 30 is not limited to that of the first embodiment, and may be the elastic arm 32 having a shape along the opening edge or may be a square frame-shape with one portion cut out, and furthermore, only the elastic arm 32 may be cut out along the axis center direction, as shown in FIGS. 23A to 24F. The distal end of the elastic arm 32 may be projected to form a projection 32*a*, or bent to form a projection 32*b*.

The plug holder 40 has a cylindrical shape that can be fitted into the plug main body 11 in a freely turning manner, where a male screw 41 is formed at half of one end side of the outer peripheral surface, and a turning operation annular rib 22 is extended from the edge on one end side of the outer peripheral surface. The plug holder 40 has a guide groove 43 communicating along the inner peripheral surface of the turning operation annular rib 42 and the outer peripheral surface of the plug main body 11 formed parallel to the axis center and at an equal pitch. Thus, the guide groove 43 can be inserted with an engagement nail 47 of the slip-out preventing member 45, to be hereinafter described. Furthermore, a male screw 44 for ensuring the effective length of the screw is formed at the other end side of the guide groove 43.

The slip-out preventing member 45 has the engagement nail 47 arranged parallel to the axis center and at an equal pitch at a ring portion 46 having an outer peripheral shape that can be fitted to the inner peripheral surface of the turning operation annular rib 22. An engagement projection 48 is arranged at the distal end of the engagement nail 47.

The coil spring 49 having an inner diameter that can be fitted into the plug main body 11 contacts and outwardly biases the ring portion 46 of the slip-out preventing member 45.

The plug housing 50 covers the shield member 30, and integrates the plug main body 11 and the electric cable 25.

A method for assembling the plug 10 including the above-described components will be described.

Figure 4A:
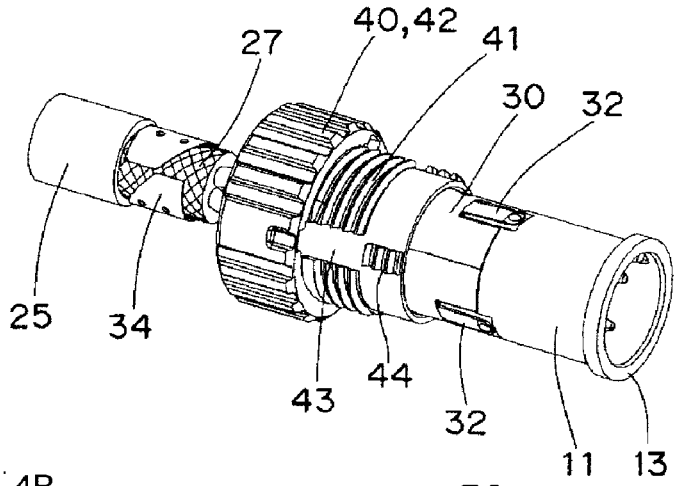
FIGS. 4A to 4C are a perspective view, a front view, and a partially enlarged view of FIG. 4B, respectively, showing the plug in the middle of assembly following FIGS. 3A to 3D.
Figure 4B:
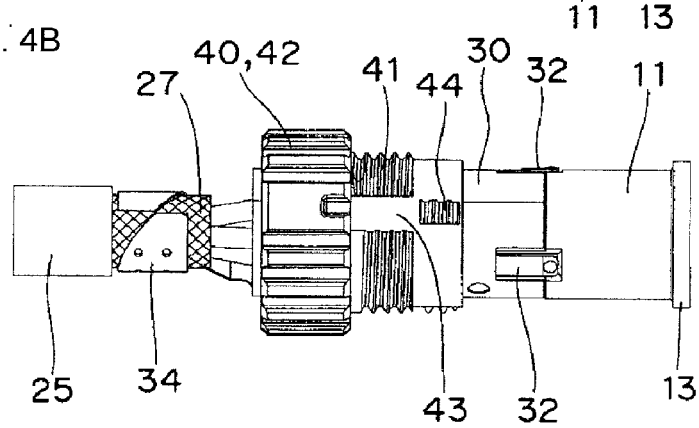
Figure 4C:
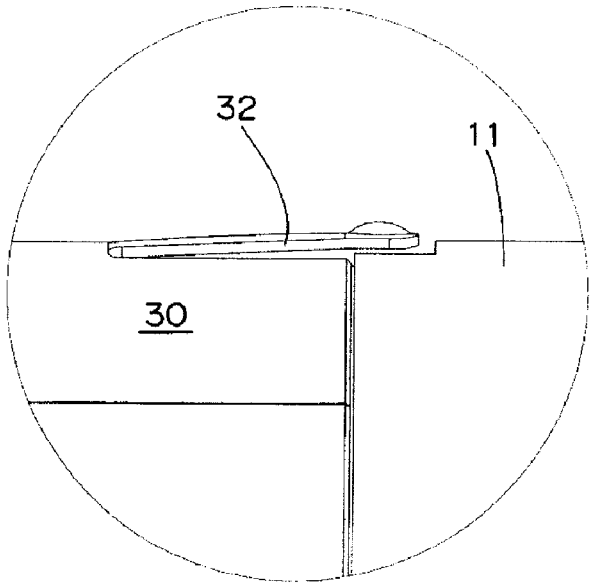
Figure 5A:
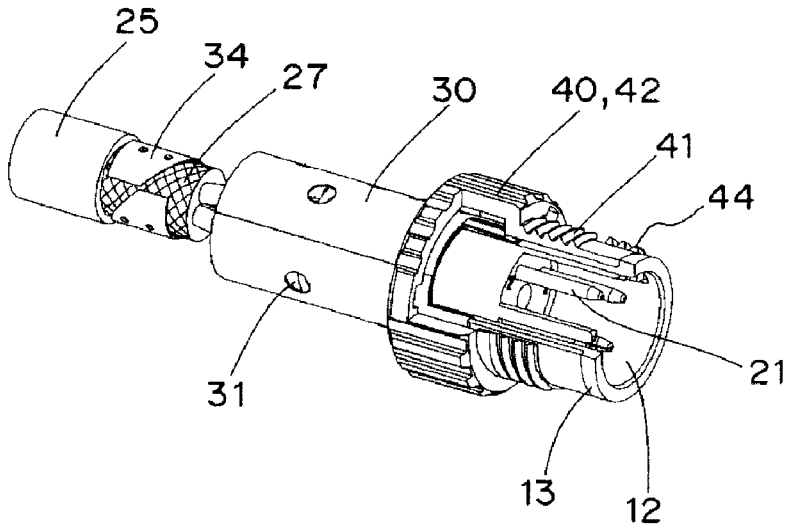
FIGS. 5A to 5C are a perspective view, a front view, and a partially enlarged view of FIG. 5B, respectively, showing the plug in the middle of assembly following FIGS. 4A to 4C.
Figure 5B:
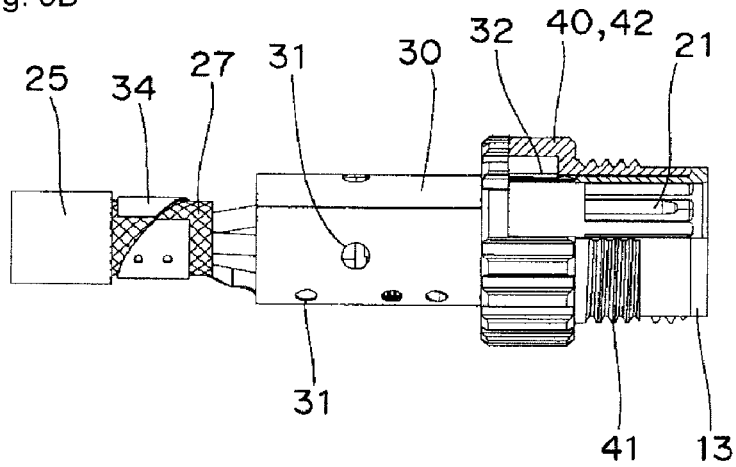
Figure 5C:
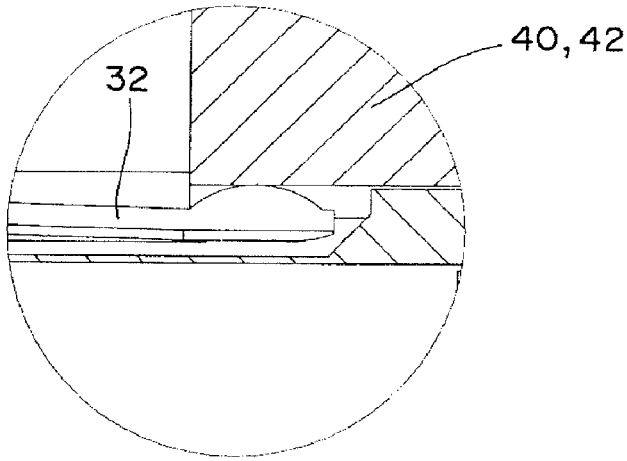
Figure 6A:
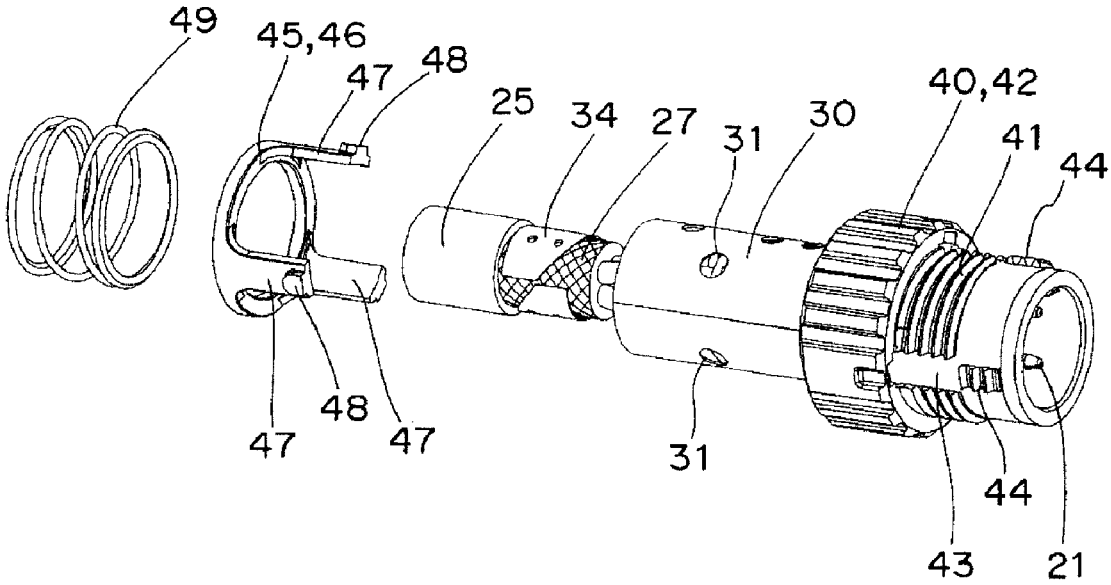
FIGS. 6A and 6B are perspective views each showing the assembly step of the plug following FIGS. 5A to 5C.
Figure 6B:
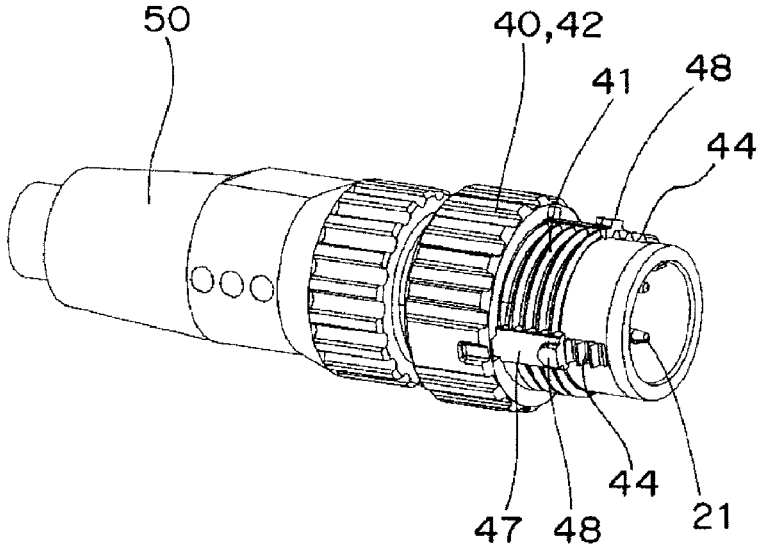
Figure 7A:
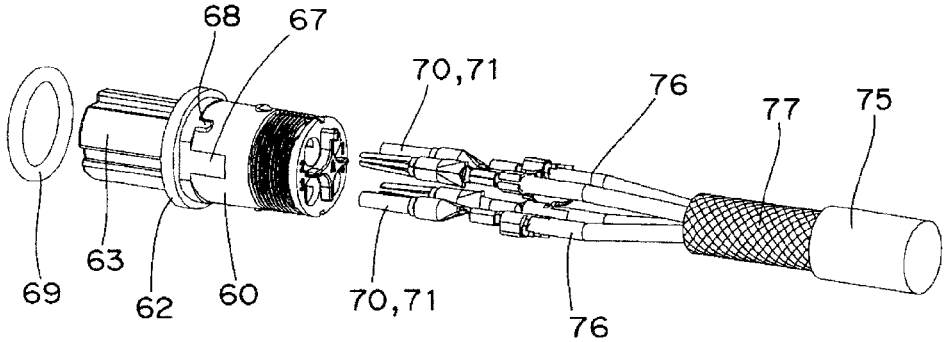
FIGS. 7A to 7D are perspective views each showing the assembly step of the socket shown in FIGS. 2A and 2B.
Figure 7B:
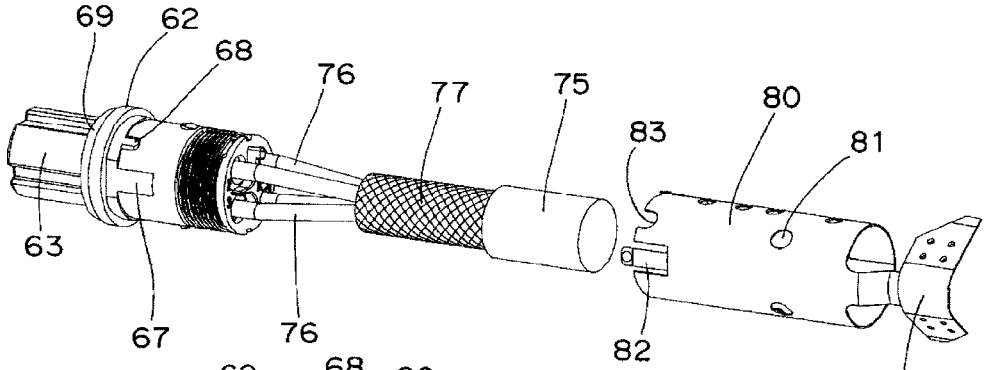
Figure 7C:
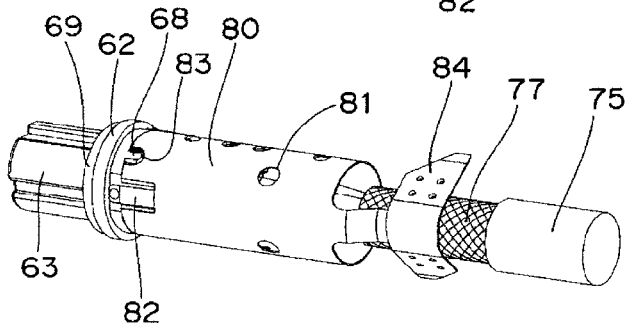
Figure 7D:
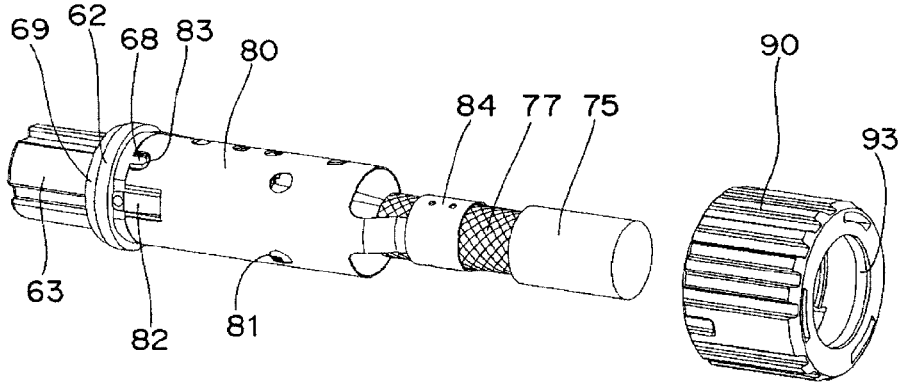

As shown in FIGS. 3A to 3D, the lead wire 26 of the electric cable 25 is pressure bonded and electrically connected to the joint 22 of the pin terminal 20. The pin terminal 20 is then press-fit into the terminal hole 15 of the plug main body 11 so that the pin 21 projects out from the bottom surface of the fit-in recessed site 12 of the plug main body 11. The shield member 30 is then fitted into the plug main body 11, thereby engaging the positioning recessed portion 33 to a positioning projection (not shown) of the plug main body 11 and positioning the elastic arm 32 in the fit-in recessed portion 18. The caulking portion 34 of the shield member 30 is then caulked and connected to the net-like shield wire 27. Furthermore, as shown in FIGS. 4A to 4C, the plug holder 40 is fitted into the shield member 30 so that the elastic arm 32 of the shield member 30 contacts and electrically connects to the inner peripheral surface of the plug holder 40 (FIGS. 5A to 5C). As shown in FIGS. 6A and 6B, the slip-out preventing member 45 is then fitted into the shield member 30 to be assembled to the inner side of the plug holder 40, and the engagement nail 47 is inserted to the guide groove 43 of the annular rib 42. The plug holder and the slip-out preventing member 45 can integrally turn by fitting the coil spring 49 into the shield member 30. However, although the plug holder 40 and the slip-out preventing member 45 are biased outward by the spring force of the coil spring 49, one end of the plug holder 40 contacts the annular rib 13 of the plug main body 11 and thus is prevented from slipping out. The shield member 30 positioned between the plug main body 11 and the electric cable 25 is integrally molded with resin to form the plug housing 50, whereby the assembly of the plug 10 is completed.

According to the present embodiment, the shield member 30 not only shields the external signals, but has an advantage of functioning as a reinforcement material for reinforcing the plug housing 50 and enhancing durability.

Figure 2A:
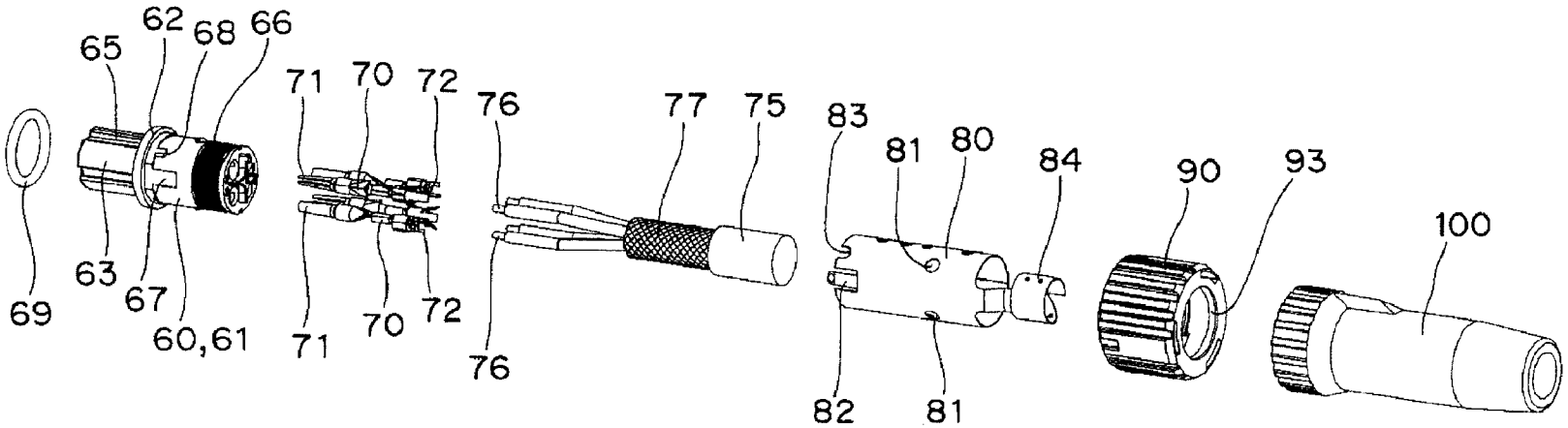
FIGS. 2A and 2B are an exploded perspective view and an exploded cross-sectional perspective view, respectively, showing a first embodiment of a socket according to the present invention.
Figure 2B:
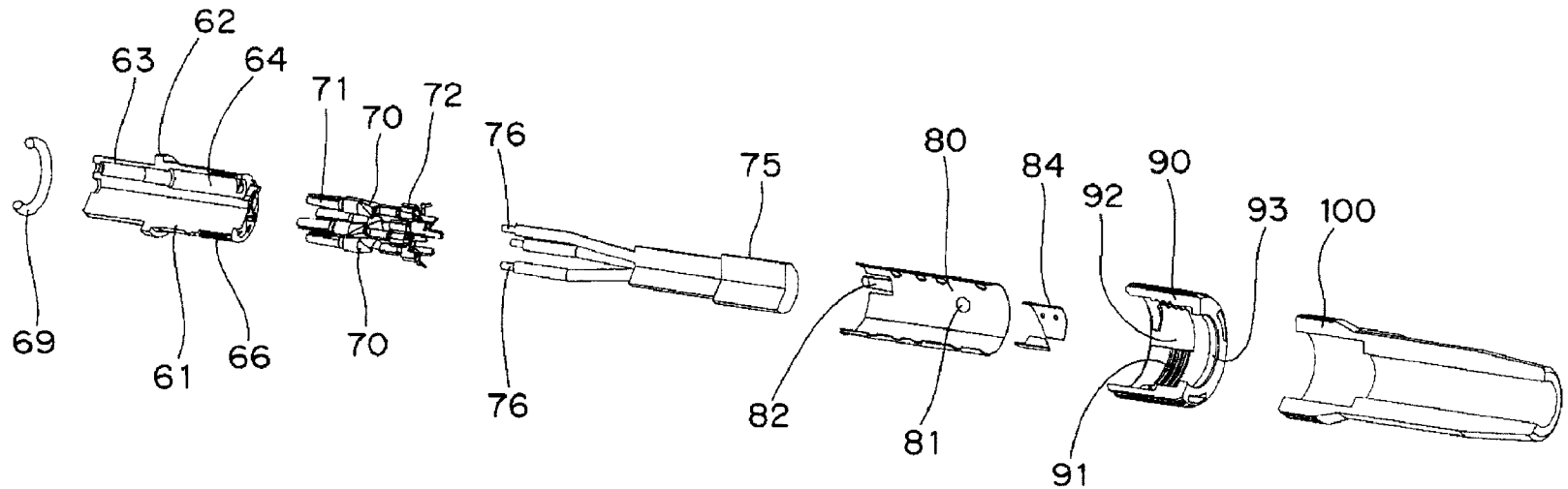
Figure 3A:
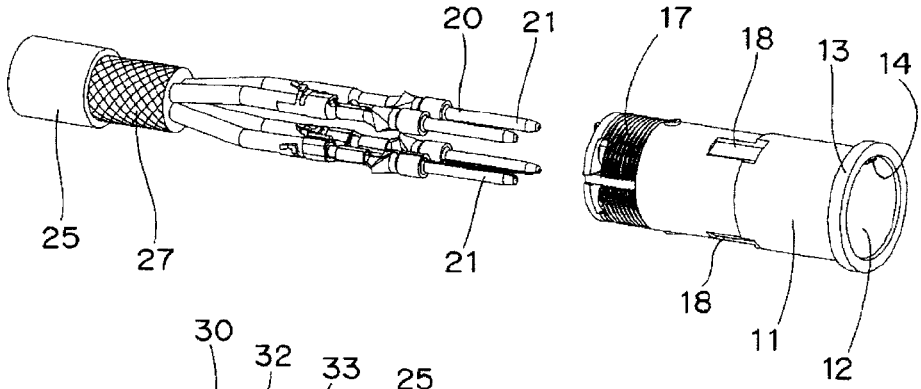
FIGS. 3A to 3D are perspective views each showing an assembly step of the plug shown in FIG. 1.
Figure 3B:
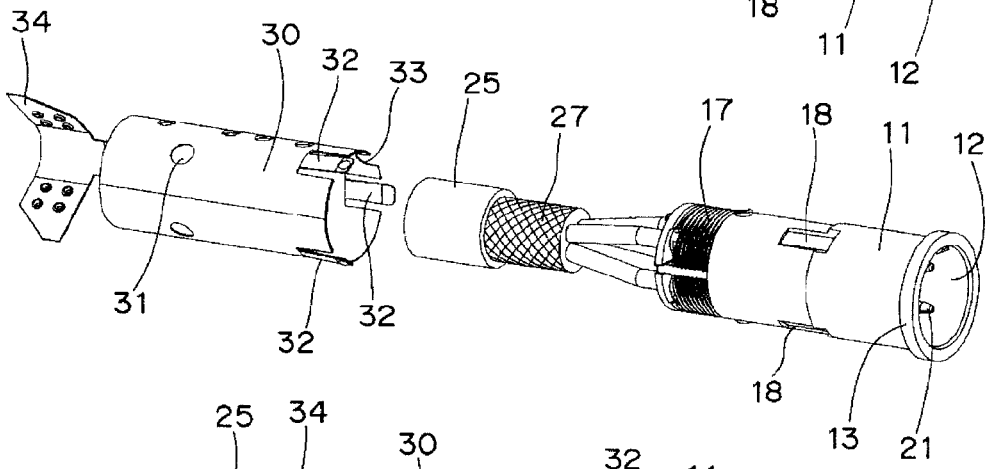
Figure 3C:
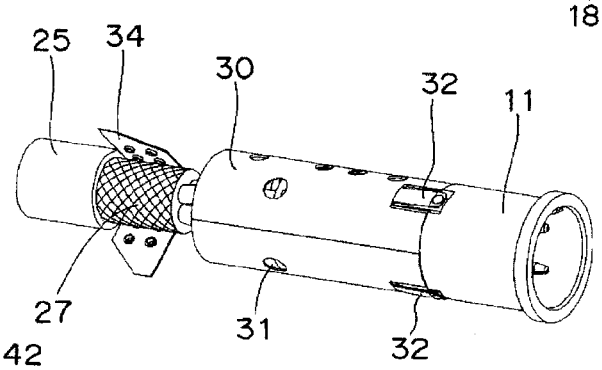
Figure 3D:
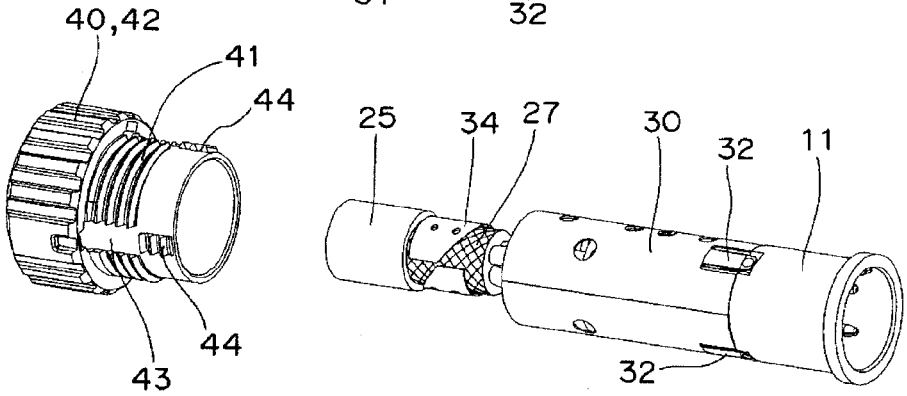

As shown in FIGS. 2A and 2B, the bayonet-type socket 60 includes a socket main body 61, an O-ring 69, a socket terminal 70, an electric cable 75, a shield member 80, a socket holder 90, and a socket housing 100.

The socket main body 61 is a columnar resin molded article having an annular rib 62 arranged at substantially the center of the outer peripheral surface, where one end side is formed as an inserting portion 63 and four terminal holes 64 communicating to both end faces are formed. A guide groove portion 65 is formed in the axis center direction on the outer peripheral surface of the inserting portion 63. Furthermore, a great number of annular projections 66 for increasing the contacting area with the socket housing 100, to be hereinafter described, and preventing dropping are formed at the side edge on the other end face of the outer peripheral surface of the socket main body 61. A fit-in recessed portion 67 is formed at a predetermined pitch at the base of the annular rib 62 of the outer peripheral surface of the socket main body 61.

The socket terminal 70 has, at one end side, arranged with a socket portion 71 that can be inserted with the pin 21 of the pin terminal 20, and at the other end side, arranged with a joint 72 that can electrically connect a lead wire 76 of the electric cable 75, to be hereinafter described.

The electric cable 75 covers four lead wires 76 with resin, and is covered with aluminum foil (not shown) and net-like shield wire 77. The lead wire 76 is electrically connected to the joint 72 of the socket terminal 70 by pressure bonding and/or soldering.

The shield member 80 is the same as the shield member 30 and has a tubular shape made of conductive material that can be fitted into the socket main body 61, where a through-hole 81 through which the resin can pass in integral molding of resin material is appropriately formed. The shield member 80 has the opening edge on one end side cut out to form an elastic arm 82 at a predetermined pitch and is arranged with a positioning recessed portion 83, and furthermore, has a caulking portion 84 extending from the opening edge on the other end side.

The socket holder 9 is a tubular body capable of accommodating the socket main body 61, where a male screw 91 is formed at the center of the inner peripheral surface, and furthermore, a guide groove 92 of substantially L-shape is formed at the edge on one end side (see FIG. 16), and a slip-out preventing annular rib 93 is formed at the opening edge on the other end side.

The socket holder 90 is not limited to the first embodiment described above, and the inner peripheral surface of the opening edge 93 may be a polyhedron, as shown in FIGS. 25A to 25F, or a circular recessed portion may be formed at a predetermined pitch to obtain a click feeling. Furthermore, the inner peripheral surface of the opening edge 93 may be formed with a net pattern. It should be recognized that such a shape of the inner peripheral surface of the opening edge 93 may be applied to the socket holder of the second embodiment, to be hereinafter described.

A method for assembling the socket 60 will now be described.

Figure 8A:
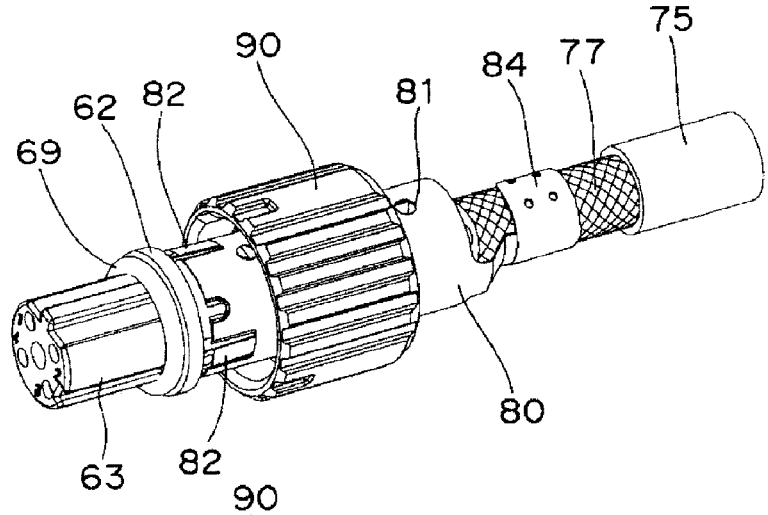
FIGS. 8A to 8C are a perspective view, a front view, and a partially enlarged view of FIG. 8B, respectively, showing the socket in the middle of assembly following FIGS. 7A to 7D.
Figure 8B:
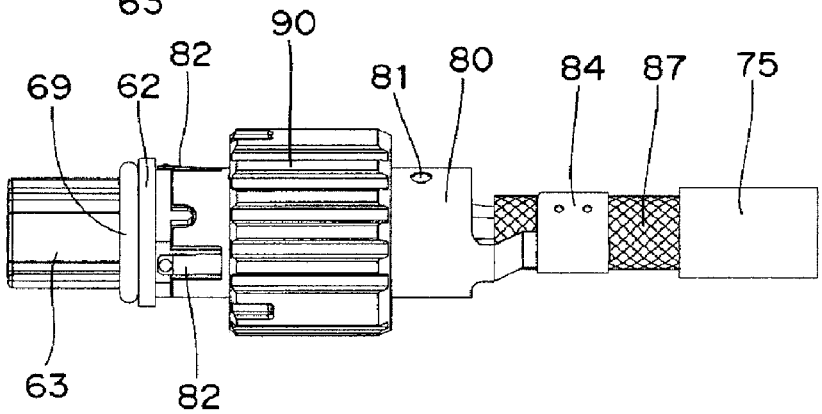
Figure 8C:
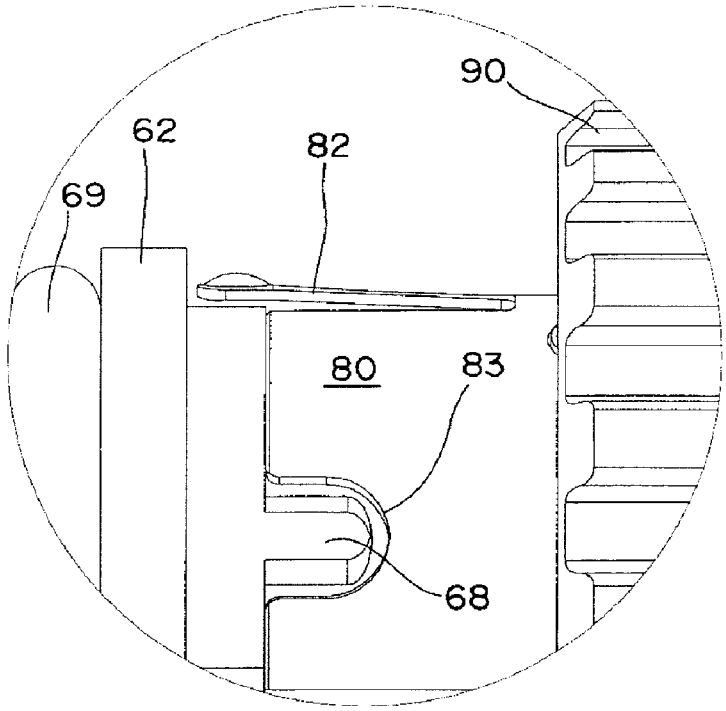
Figure 9A:
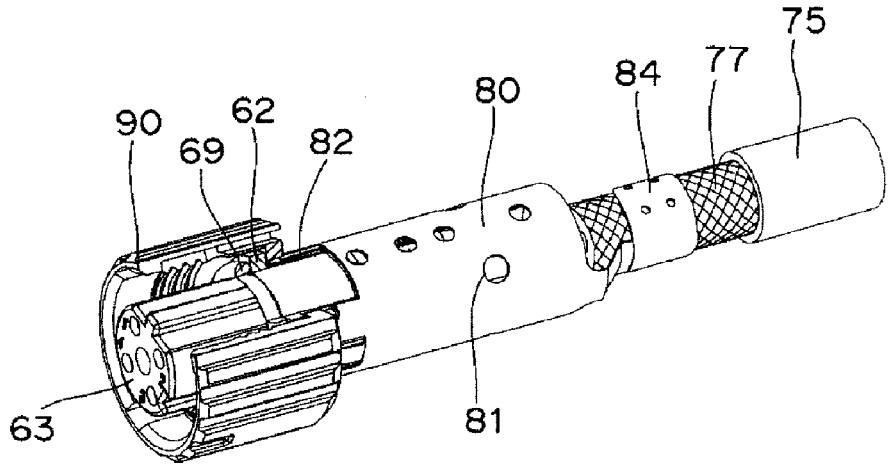
FIGS. 9A to 9C are a perspective view, a front view, and a partially enlarged view of FIG. 9B, respectively, showing the socket in the middle of assembly following FIGS. 8A to 8C.
Figure 9B:
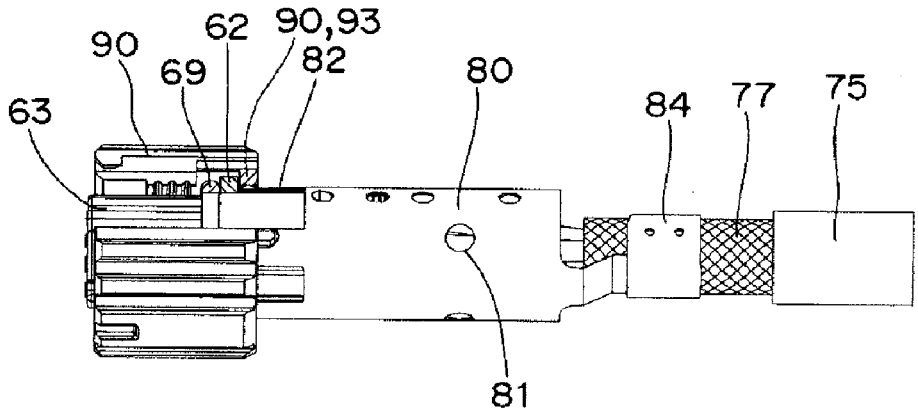
Figure 9C:
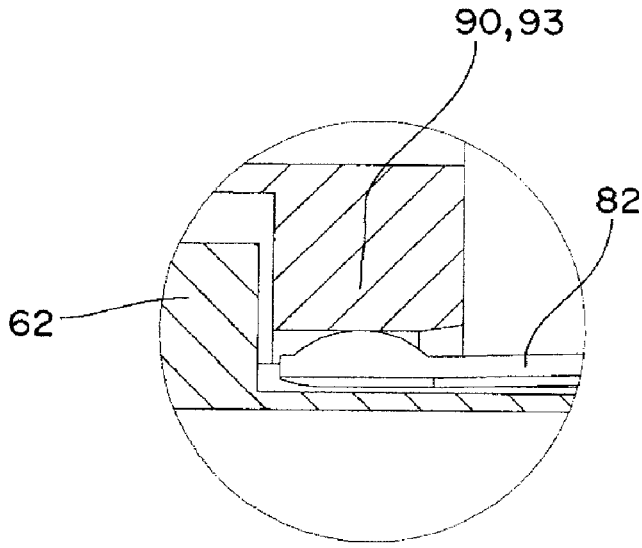
Figure 10A:
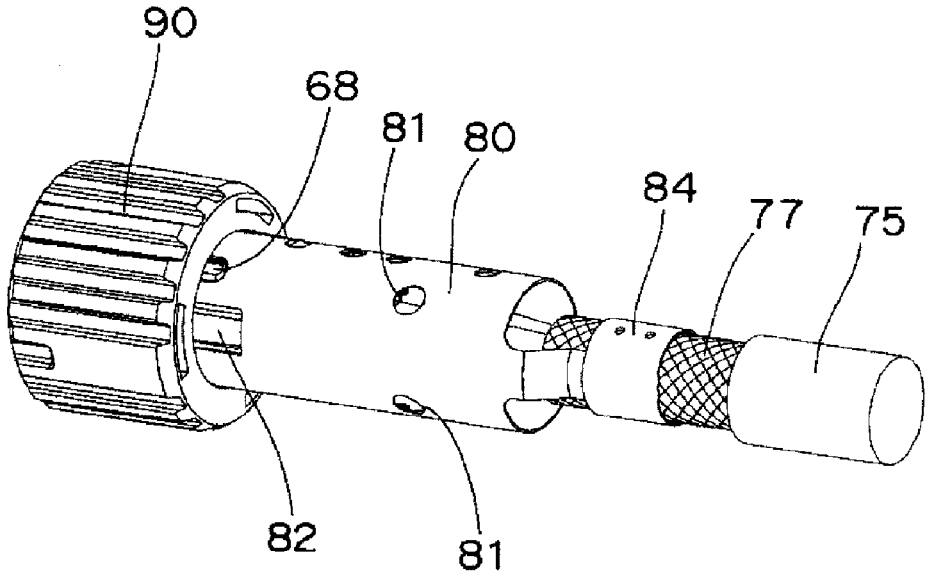
FIGS. 10A and 10B are perspective views each showing an assembly step of the socket following FIGS. 9A to 9C.
Figure 10B:
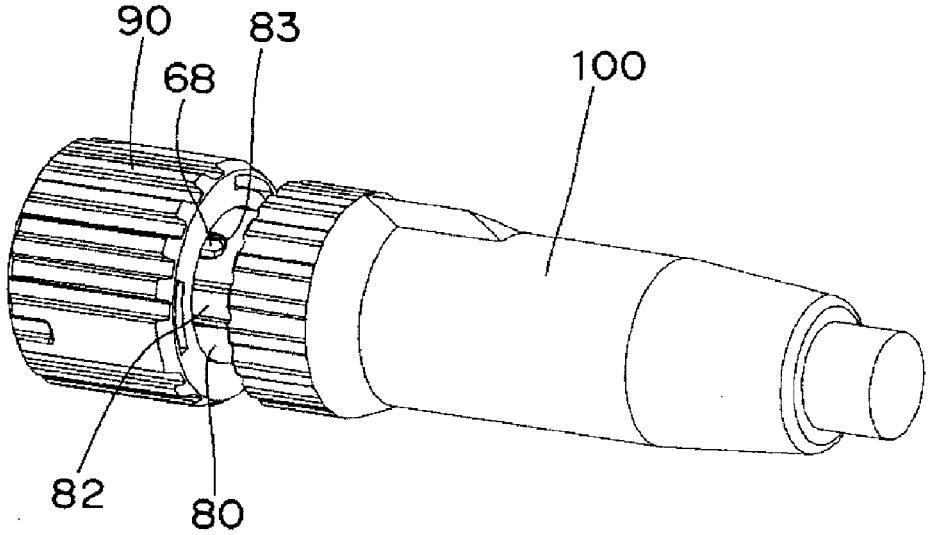
Figure 11E:
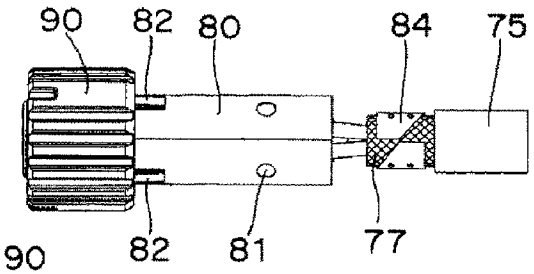
FIGS. 11E to 11H show a socket in the middle of assembly and after assembly.
Figure 11F:
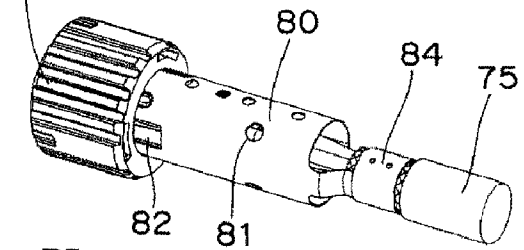
Figure 11G:
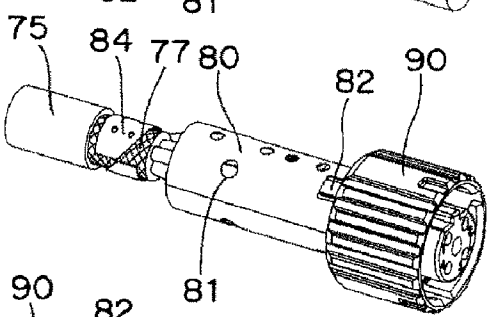
Figure 11H:
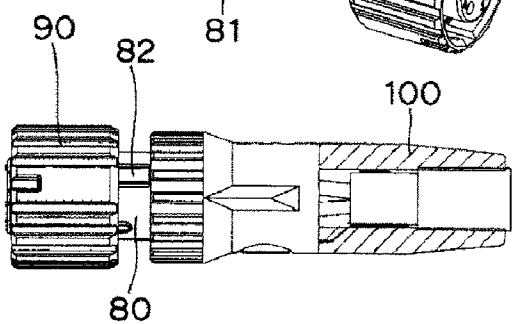
Figure 11A:
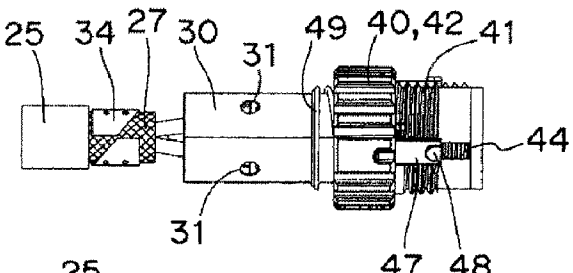
FIGS. 11A to 11D show a plug in the middle of assembly and after assembly.
Figure 11B:
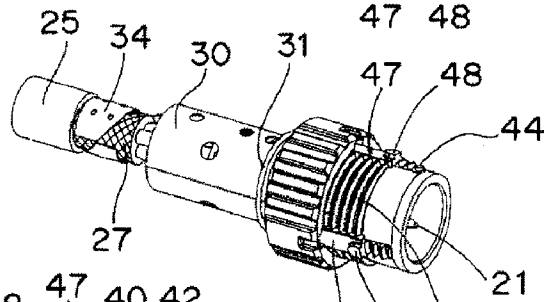
Figure 11C:
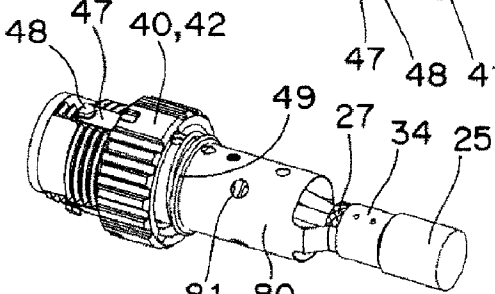
Figure 11D:
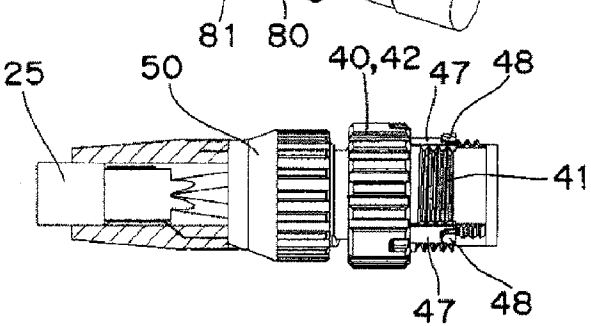

As shown in FIGS. 7A to 7D, the O-ring 69 is attached to the socket main body 61. The lead wire 76 of the electric cable 75 is electrically connected to the joint 72 of the socket terminal 70. The socket terminal 70 is press-fit into the terminal hole 64 of the socket main body 61. The positioning recessed portion 83 of the shield member 80 is engaged with the positioning projection 68 of the socket main body 61 to position the elastic arm 82 in the fit-in recessed portion 67. The caulking portion 84 of the shield member 80 is caulked and connected to the net-like shield wire 77. Furthermore, as shown in FIGS. 8A to 8C, the socket holder 90 is fitted into the shield member 80, so that the elastic arm 82 of the shield member 80 contacts and electrically connects to the inner peripheral surface of the annular rib 93 of the socket holder 90 (FIGS. 9A to 9C). As shown in FIGS. 10A and 10B, the shield member 80 is resin molded, and the socket housing 100 is formed, thereby strongly integrating socket main body 61 and the electric cable 75, whereby the assembly of the socket 60 is completed.

According to the present embodiment, the shield member 80 not only shields the external signals, but has an advantage of functioning as a reinforcement material for reinforcing the socket housing 100 and enhancing durability.

A second embodiment is a case applied to a connector including the screw-type plug 10 and the socket 60, as shown in FIGS. 12A to 13B.

Figure 12A:
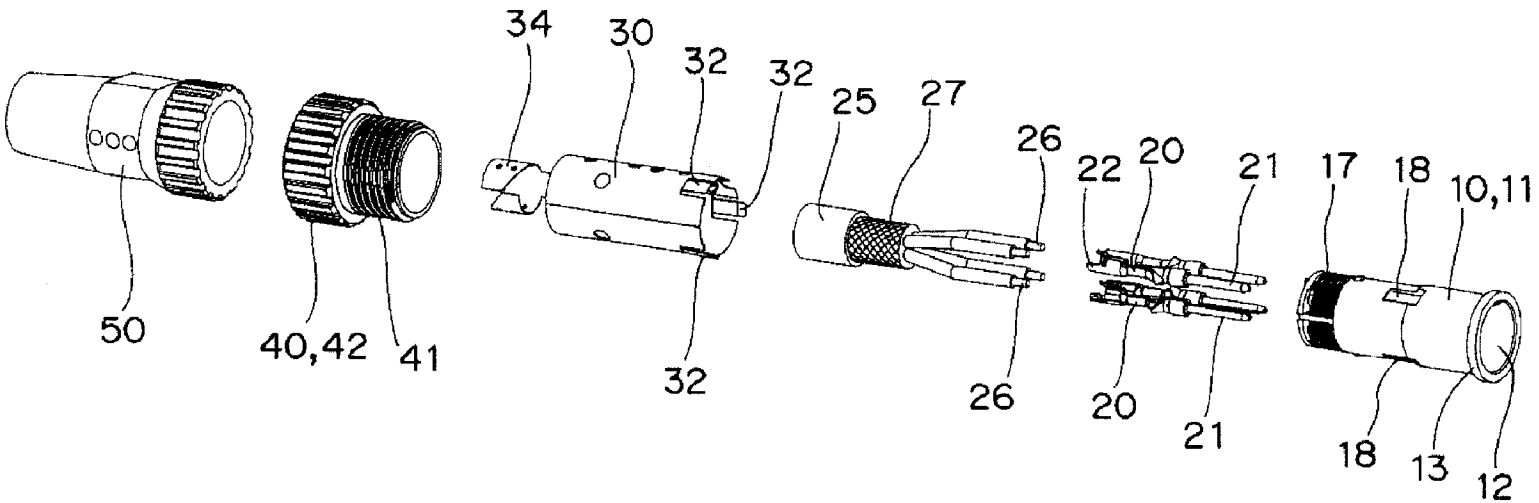
FIGS. 12A and 12B are an exploded perspective view and an exploded cross-sectional perspective view, respectively, showing a second embodiment of a plug according to the present invention.
Figure 12B:
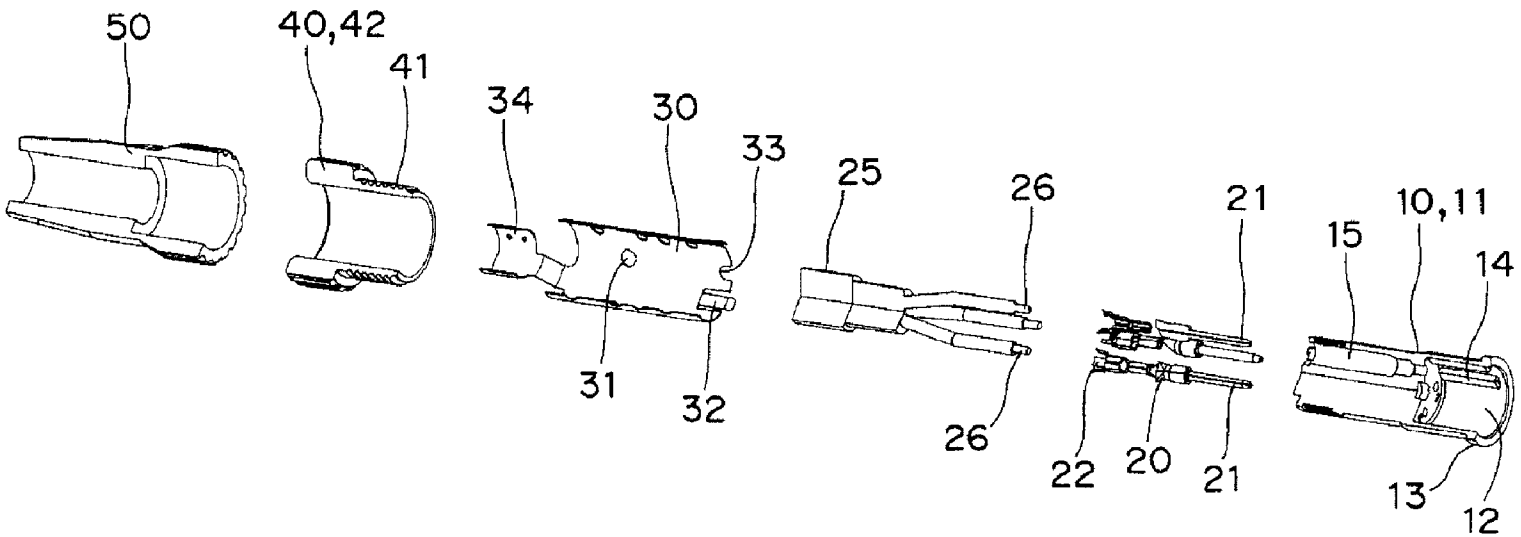

As shown in FIGS. 12A and 12B, the screw-type plug 10 has a configuration similar to the bayonet-type plug according to the first embodiment, and thus like reference numbers are denoted for like portions and the description thereof will not be given, and only the different portions will be described in detail.

The plug 10 according to the second embodiment does not include the slip-out preventing member and the coil spring, and the shape of the plug holder 40 is different. The plug holder 40 has a cylindrical shape capable of fitting into the plug main body 11 in a freely turning manner, where the male screw 41 is formed over the entire outer peripheral surface and the turning operation annular rib 42 is extended from the edge on one end side of the outer peripheral surface.

The method for assembling the screw-type plug 10 is substantially the same as the bayonet-type plug according to the first embodiment, and thus the description thereof will not be given.

Figure 13A:
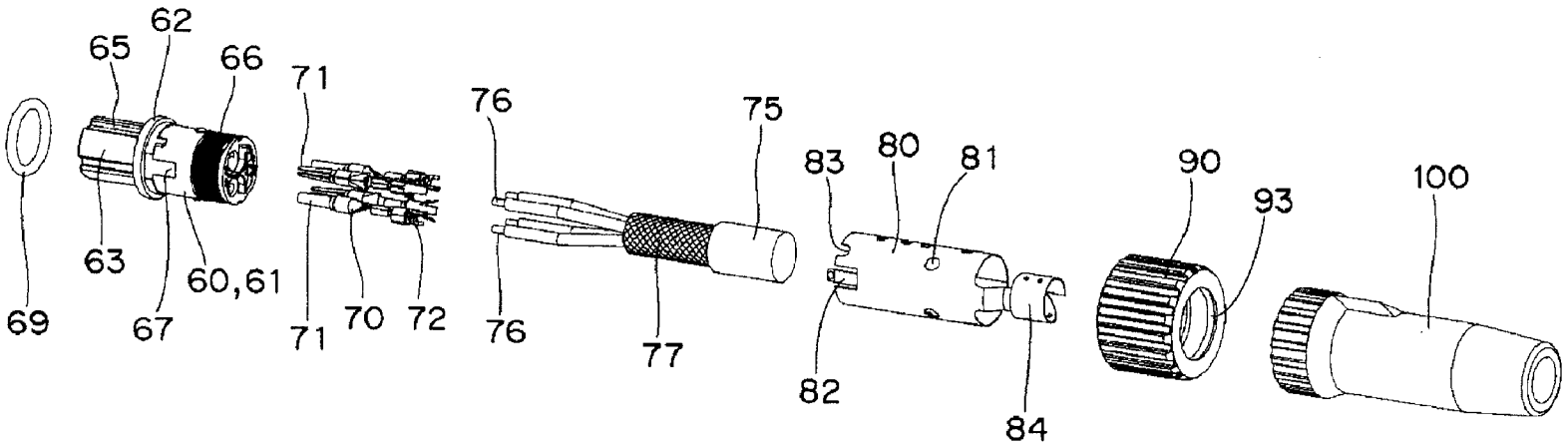
FIGS. 13A and 13B are an exploded perspective view and an exploded cross-sectional perspective view, respectively, showing the second embodiment of a socket according to the present invention.
Figure 13B:
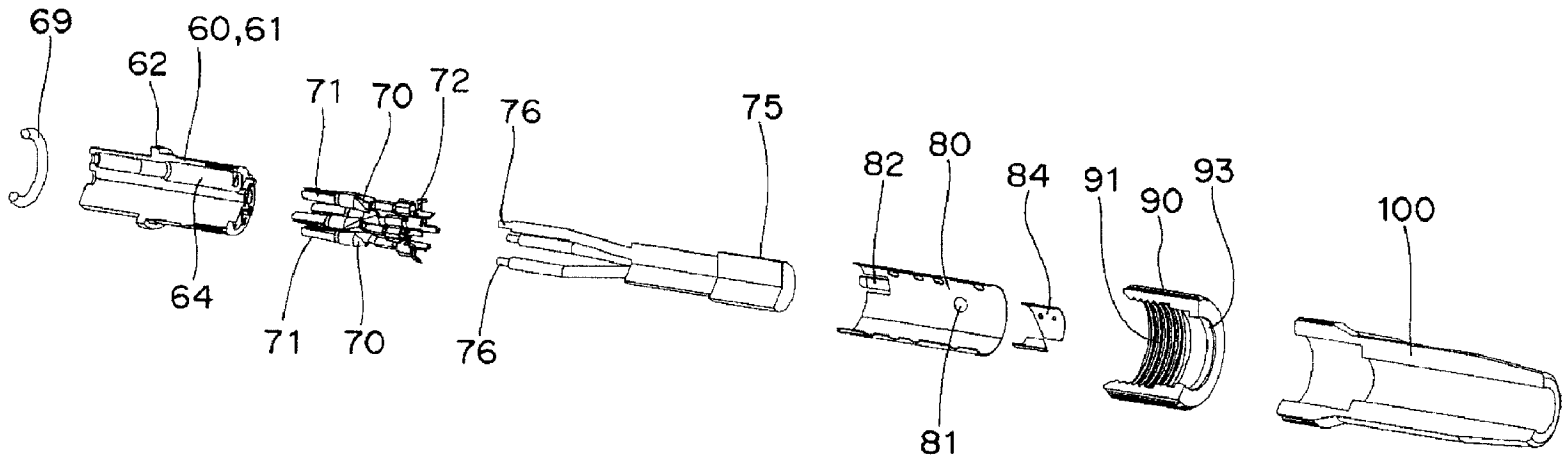
Figure 14A:
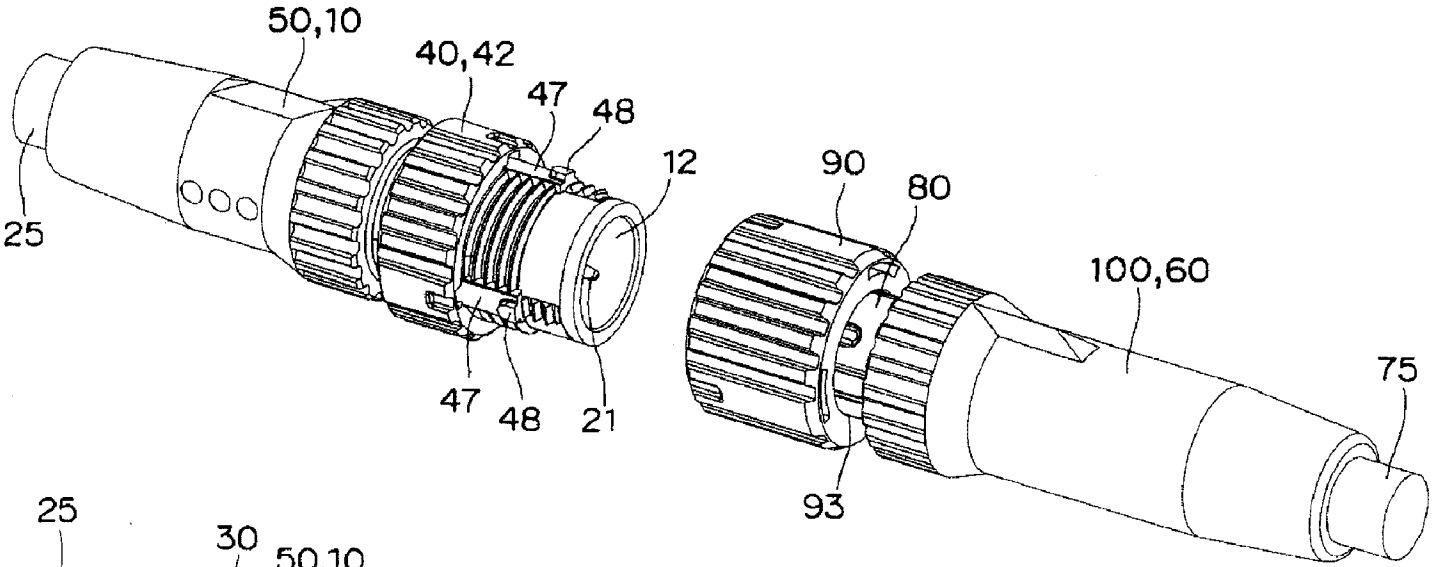
FIGS. 14A and 14B are a perspective view and a cross-sectional perspective view, respectively, showing a state before connection of the plug and the socket shown in FIGS. 1A, 1B, 2A, and 2B.
Figure 14B:
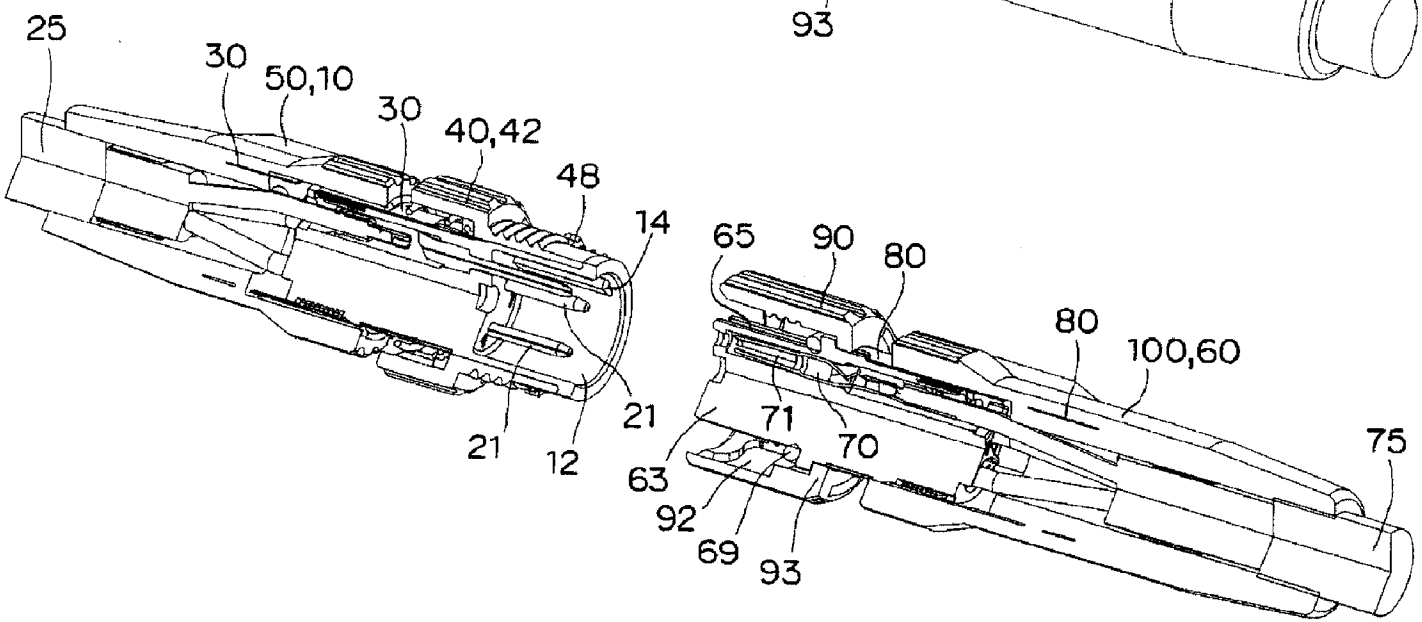
Figure 15A:
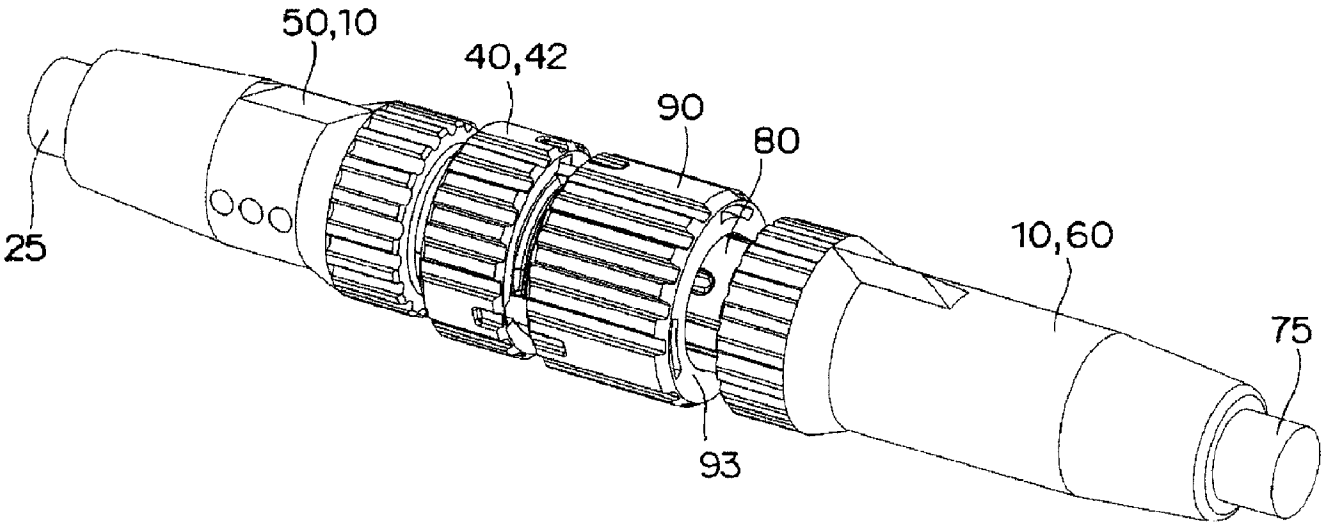
FIGS. 15A and 15B are a perspective view and a cross-sectional perspective view, respectively, showing a state after connection of the plug and the socket shown in FIGS. 1A, 1B, 2A, and 2B.
Figure 15B:
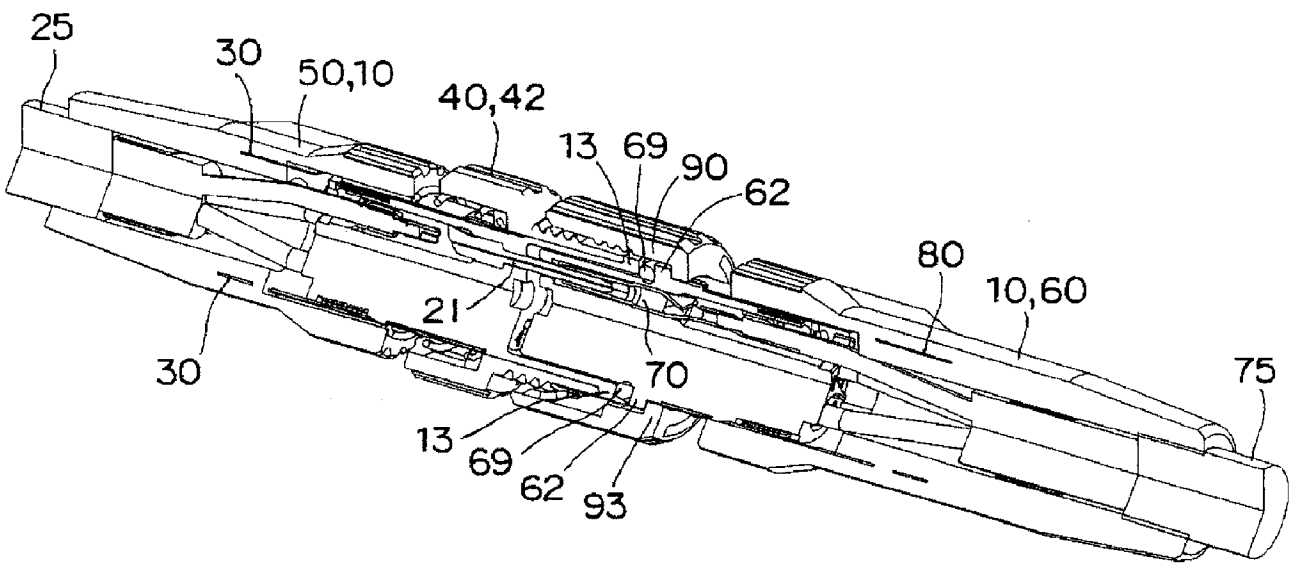
Figure 16:
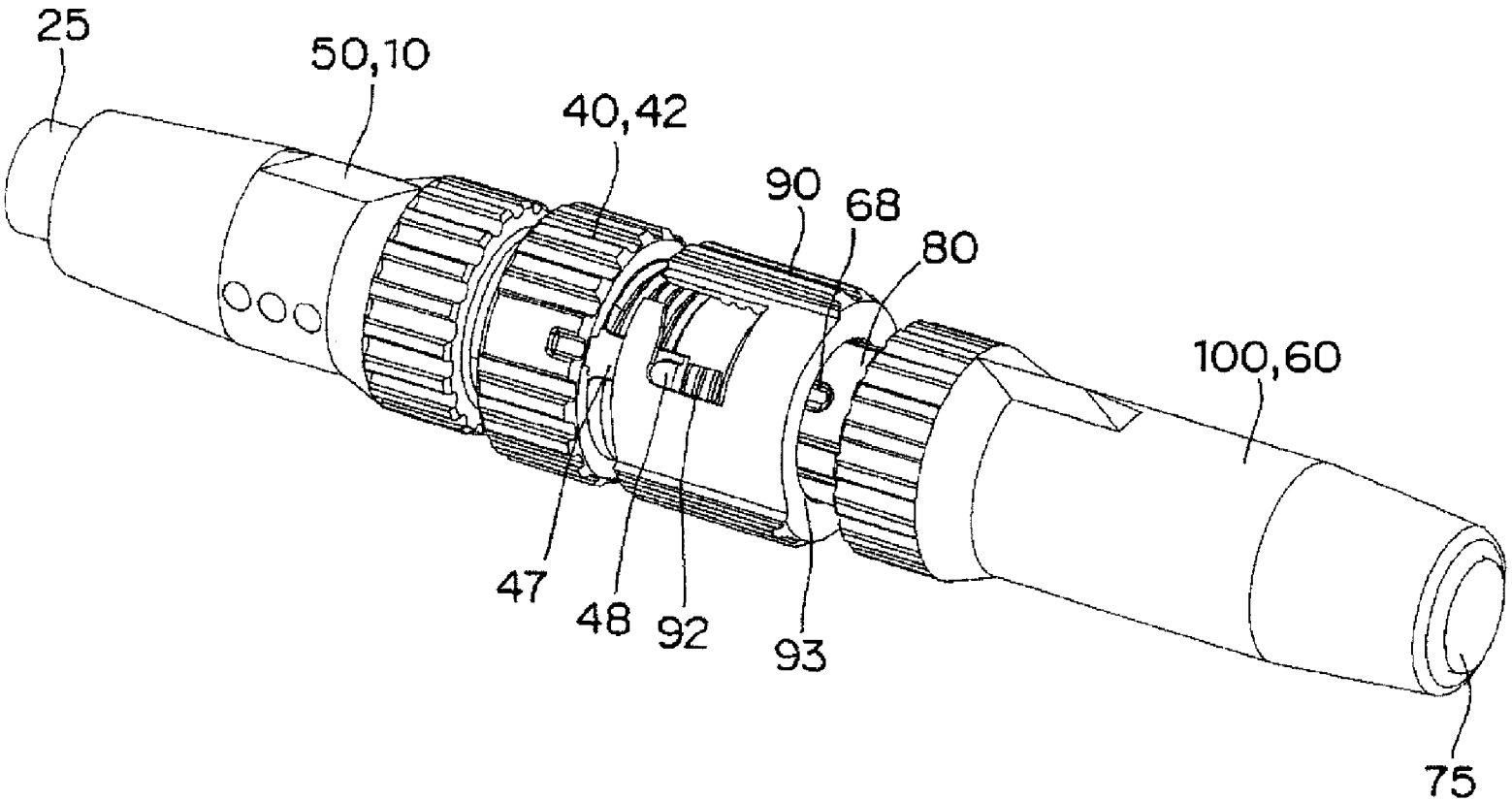
FIG. 16 is a partially cut perspective view with part of the socket shown in FIG. 15A cut out.

As shown in FIGS. 13A and 13B, the screw-type socket 60 is the same as bayonet-type socket of the first embodiment in basic configuration, and differs in that the socket holder 90 is formed with only a female screw 91 at the opening edge on one end side from the center of the inner peripheral surface.

The method for assembling the screw-type socket 60 is the same as the bayonet-type socket according to the first embodiment described above, and thus the description thereof will not be given.

A first connection method for connecting the bayonet-type plug 10 and the socket 60 according to the first embodiment will be described below.

As shown in FIGS. 14A to 16, the guide groove portion 65 arranged at the inserting portion 63 of the socket main body 61 is fitted into and positioned at the guide protrusion 14 arranged at the fit-in recessed site 12 of the plug main body 11, and then pushed in so that the pin 21 of the pin terminal 20 is inserted to and electrically connected to the socket portion 71 of the socket terminal 70. The plug holder 40 and the socket holder 90 are relatively rotated in different directions so that the engagement nail 47 of the slip-out preventing member 45 biased outward by the spring force of the coil spring 49 enters the substantially L-shaped guide groove 92 arranged at the inner peripheral surface of the socket holder 90, whereby an operation feeling can be obtained. The plug holder 40 and/or the socket holder 90 is then turned so that the engagement projection 48 of the engagement nail 47 engages the guide groove 92 (FIG. 16) to be in a locked state, and the annular ribs 13, 62 compress and hold the O-ring 69 thereby also ensuring high water proof property (FIG. 15B).

A second connection method is for connecting the bayonet-type plug 10 of the first embodiment and the screw-type socket 60 of the second embodiment, as shown in FIGS. 17A to 18B. The bayonet-type plug 10 is the same as the first embodiment described above, and thus like reference numbers are denoted for like portions and the description thereof will not be given.

As shown in FIG. 13, the screw-type socket 60 is substantially similar to the bayonet-type socket according to the first embodiment but differs in that only the female screw 91 is formed at half of one side of the inner peripheral surface of the socket holder 90. Thus, like reference numbers are denoted for like portions as the bayonet-type socket 60 according to the first embodiment and the description thereof will not be given.

Figure 17A:
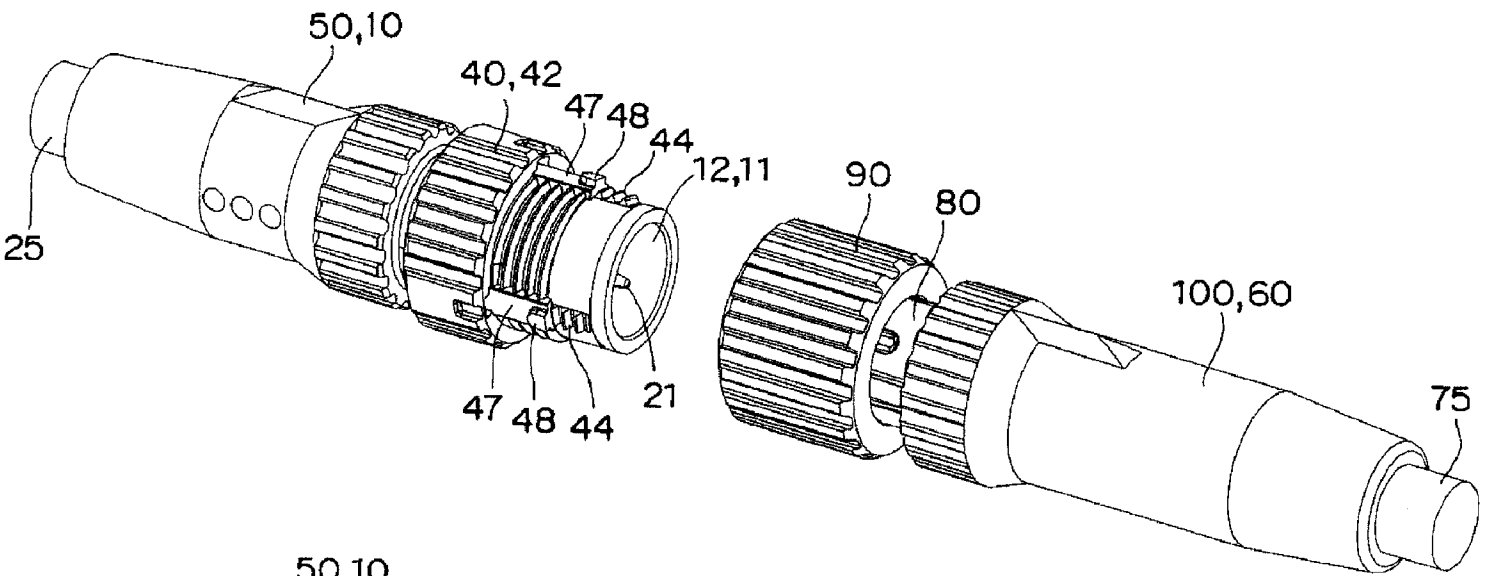
FIGS. 17A and 17B are a perspective view and a cross-sectional perspective view, respectively, showing a state before connection of the plug of the first embodiment and the socket of the second embodiment according to the present invention.
Figure 17B:
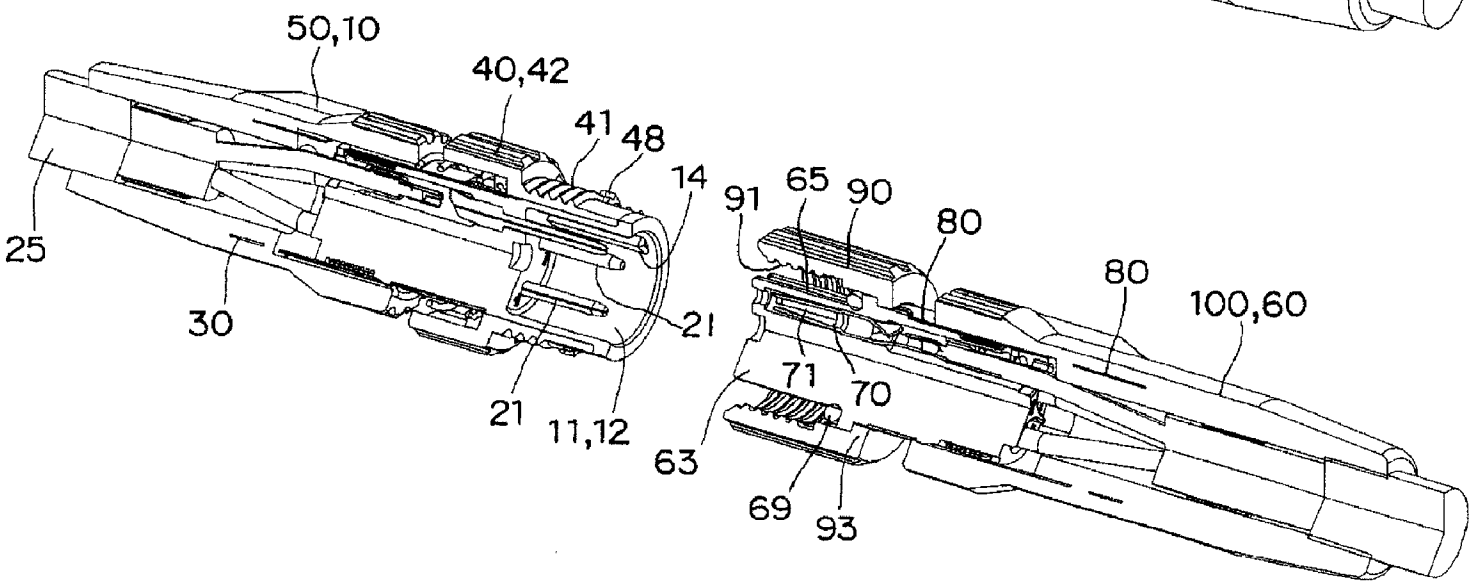
Figure 18A:
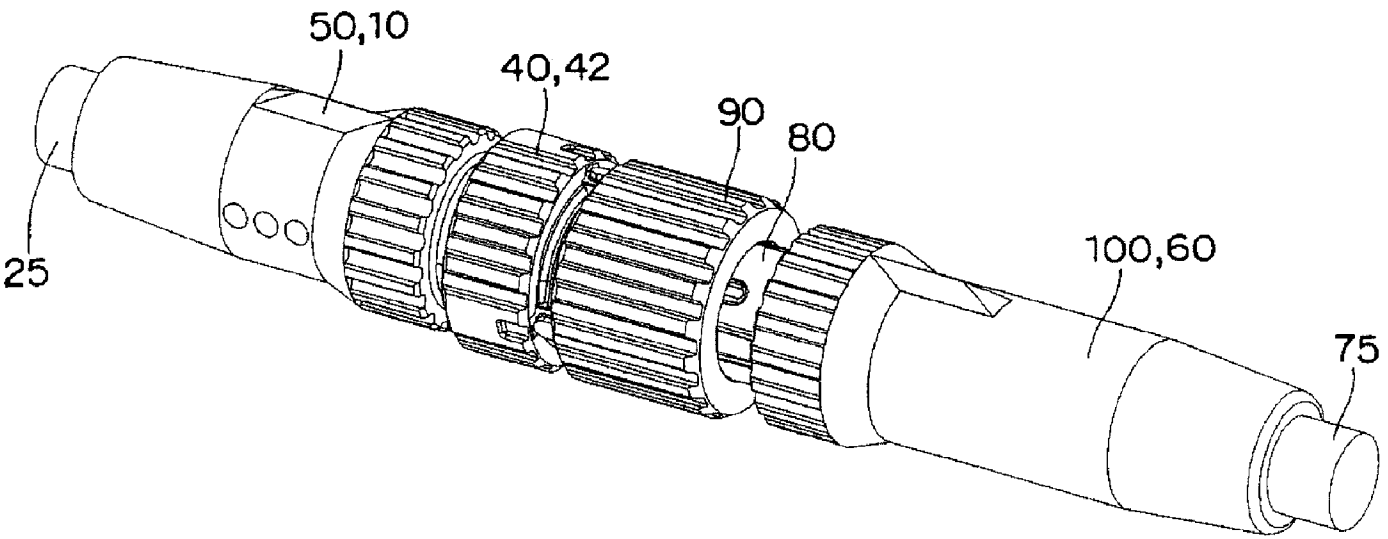
FIGS. 18A and 18B are a perspective view and a cross-sectional perspective view, respectively, showing a state before connection of the plug of the first embodiment and the socket of the second embodiment according to the present invention.
Figure 18B:
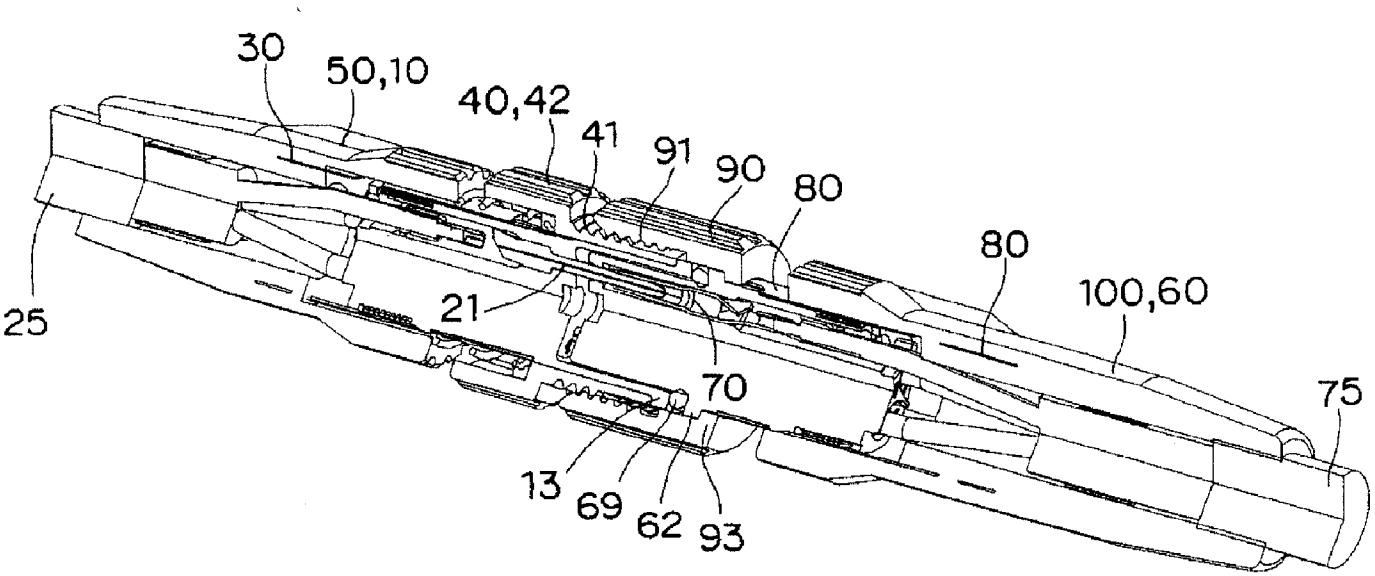

When connecting the bayonet-type plug 10 and the screw-type socket 60 having the above configuration, as shown in FIGS. 17 and 18, the guide groove portion 65 arranged at the inserting portion 63 of the socket main body 61 is fitted into and positioned at the guide protrusion 14 arranged at the fit-in recessed site 12 of the plug main body 11, and then pushed in so that the pin 21 of the pin terminal 20 is inserted to and electrically connected to the socket portion 71 of the socket terminal 70. The plug holder 40 and the socket holder 90 are relatively rotated in different directions so that the female screw 91 of the socket holder 90 screw-fits into the male screws 44, 41 of the plug holder 40. Thus, the distal end face of the socket holder 90 contacts the engagement projection 48 of the slip-out preventing member 45, and pushes the slip-out preventing member 45 in to a locked state against the spring force of the coil spring 49. The annular ribs 13, 62 thus compress and hold the O-ring 69 thereby ensuring high water proof property, as shown in FIG. 18B.

According to the present embodiment, electrical connection can be made to the existing screw-type socket 60, the usable range can be extended, and convenience increases.

Figure 19A:
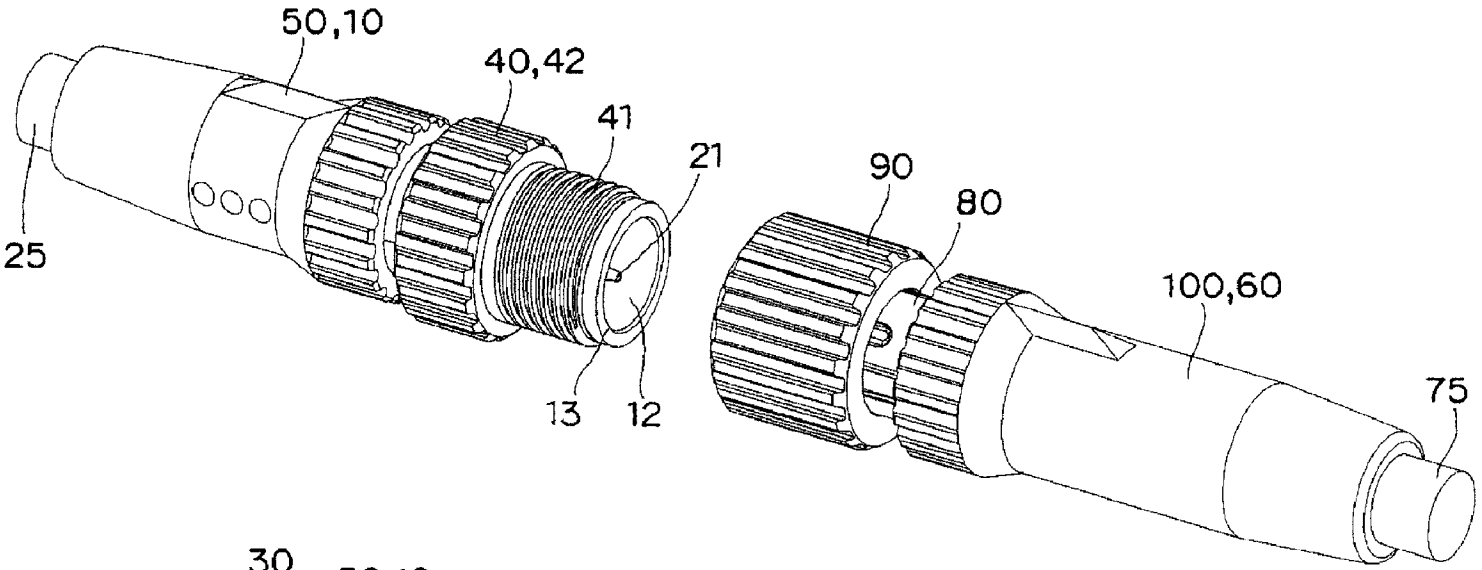
FIGS. 19A and 19B are a perspective view and a cross-sectional perspective view, respectively, showing a state before connection of the plug of the second embodiment and the socket of the second embodiment according to the present invention.
Figure 19B:
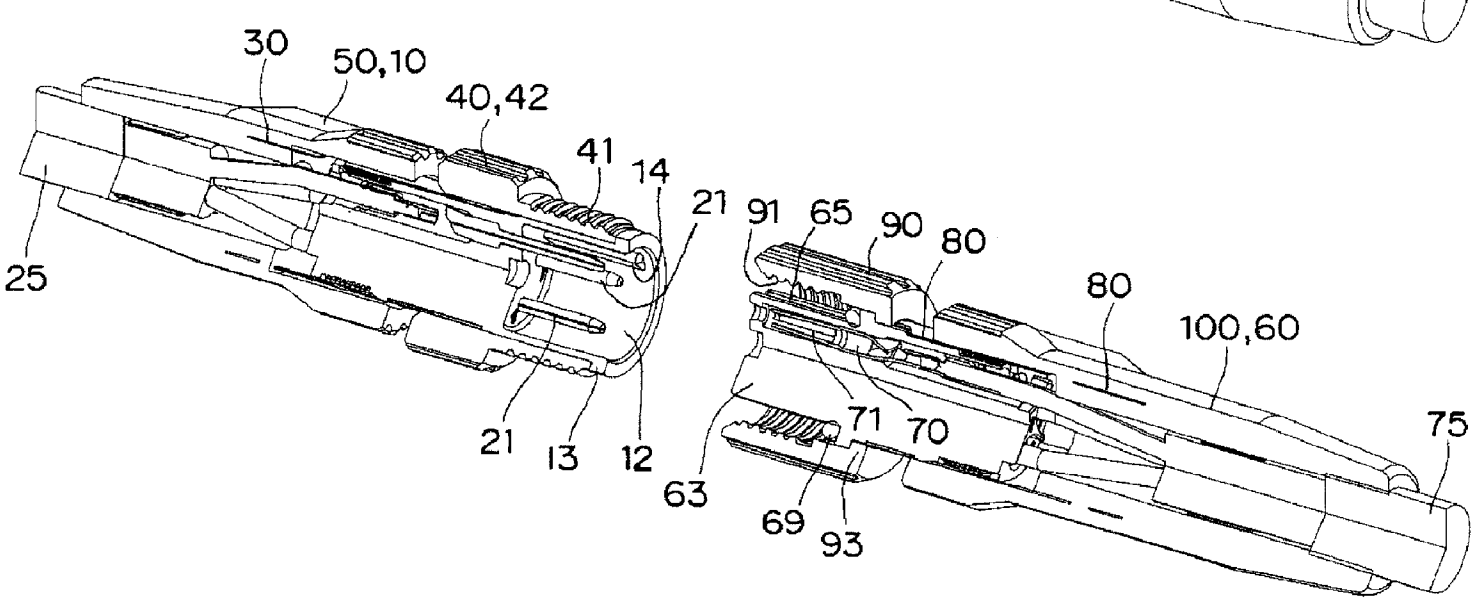
Figure 20A:
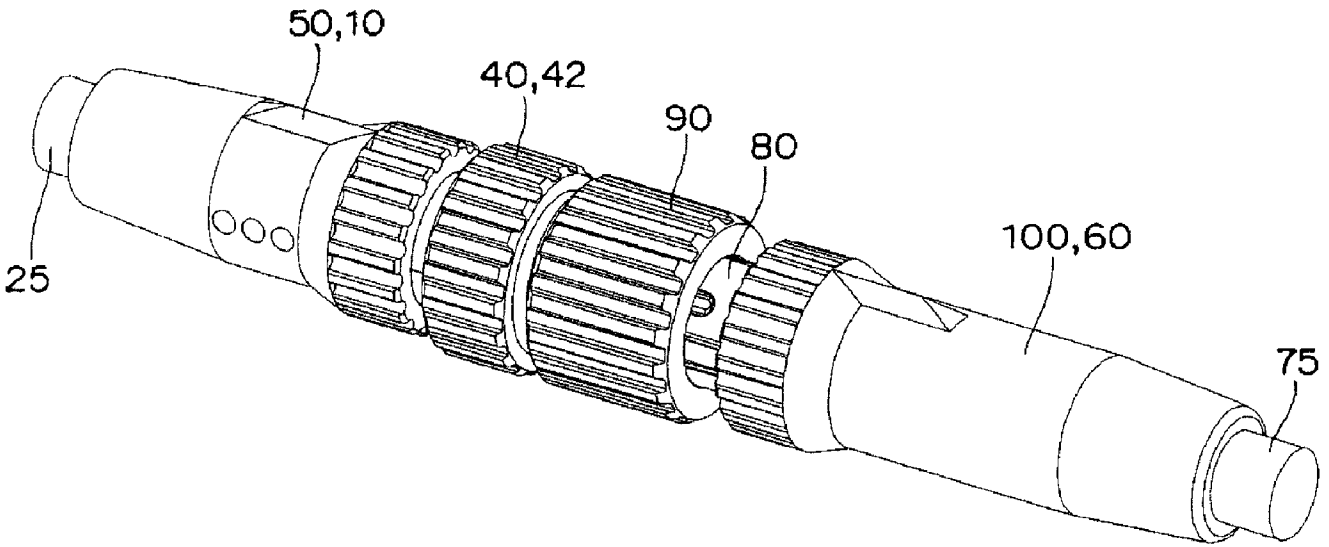
FIGS. 20A and 20B are a perspective view and a cross-sectional perspective view, respectively, showing a state before connection of the plug of the second embodiment and the socket of the second embodiment according to the present invention.
Figure 20B:
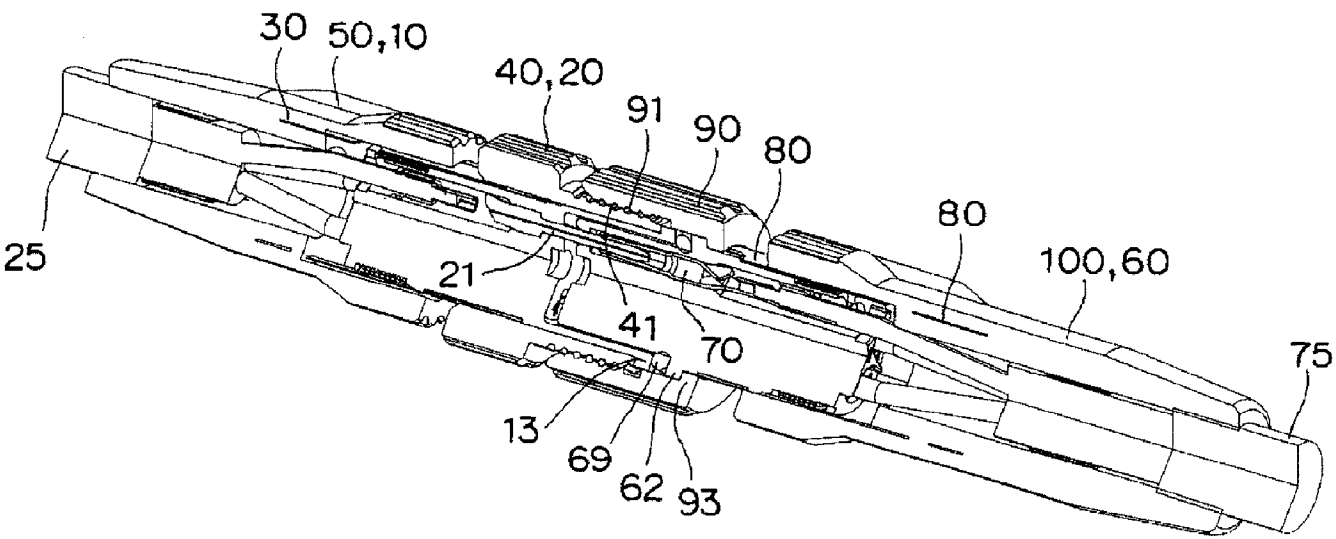

A third connection method is for connecting the screw-type plug 10 and the screw-type socket 60 of the second embodiment, as shown in FIGS. 19 and 20. As shown in FIG. 12, the screw-type plug 10 does not include the slip-out preventing member or the coil spring. Furthermore, the plug holder 40 has a cylindrical shape capable of fitting into the plug main body 11 in a freely turning manner, where the male screw 41 is formed over the entire outer peripheral surface and the turning operation annular rib 42 is extended from the edge on one end side of the outer peripheral surface. Like reference numbers are denoted for like portions, and thus the description thereof will not be given.

When connecting the screw-type plug 10 and the screw-type socket 60, as shown in FIGS. 19A and 19B, the guide groove portion 65 arranged at the inserting portion 63 of the socket main body 61 is fitted into and positioned at the guide protrusion 14 arranged at the fit-in recessed site 12 of the plug main body 11, and then pushed in so that the pin 21 of the pin terminal 20 is inserted to and electrically connected to the socket portion 71 of the socket terminal 70. The plug holder 40 and the socket holder 90 are relatively rotated in different directions so that the male screw 41 of the plug holder 40 is screwed into the female screw 91 of the socket holder 90 and tightened to be in a locked state. The annular ribs 13, 62 compress and hold the O-ring 69 thereby ensuring high water proof property.

Figure 21A:
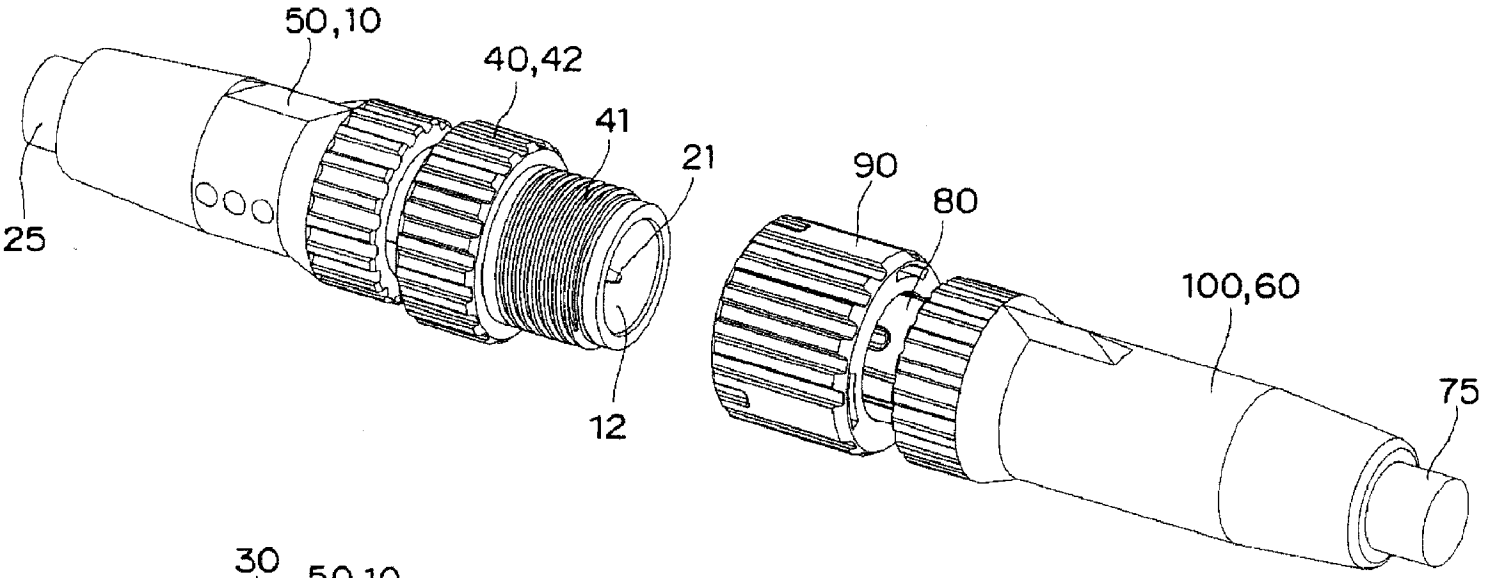
FIGS. 21A and 21B are a perspective view and a cross-sectional perspective view, respectively, showing a state before connection of the plug of the second embodiment and the socket of the first embodiment according to the present invention.
Figure 21B:
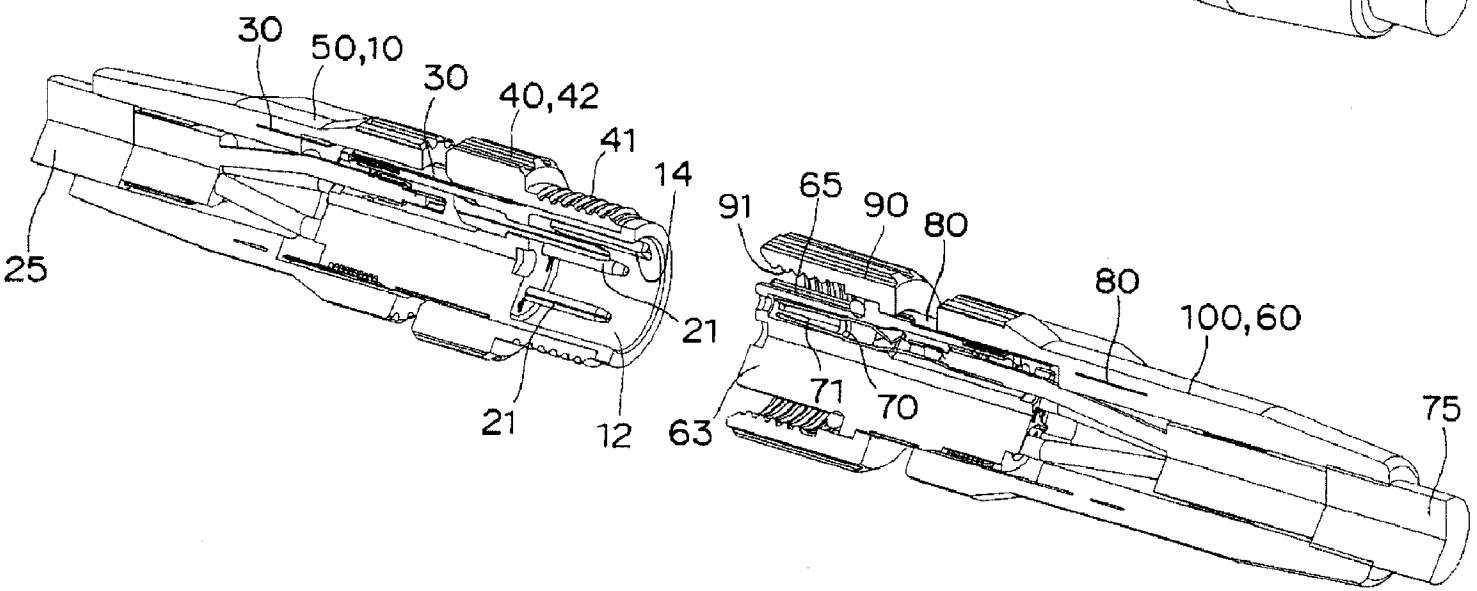
Figure 22A:
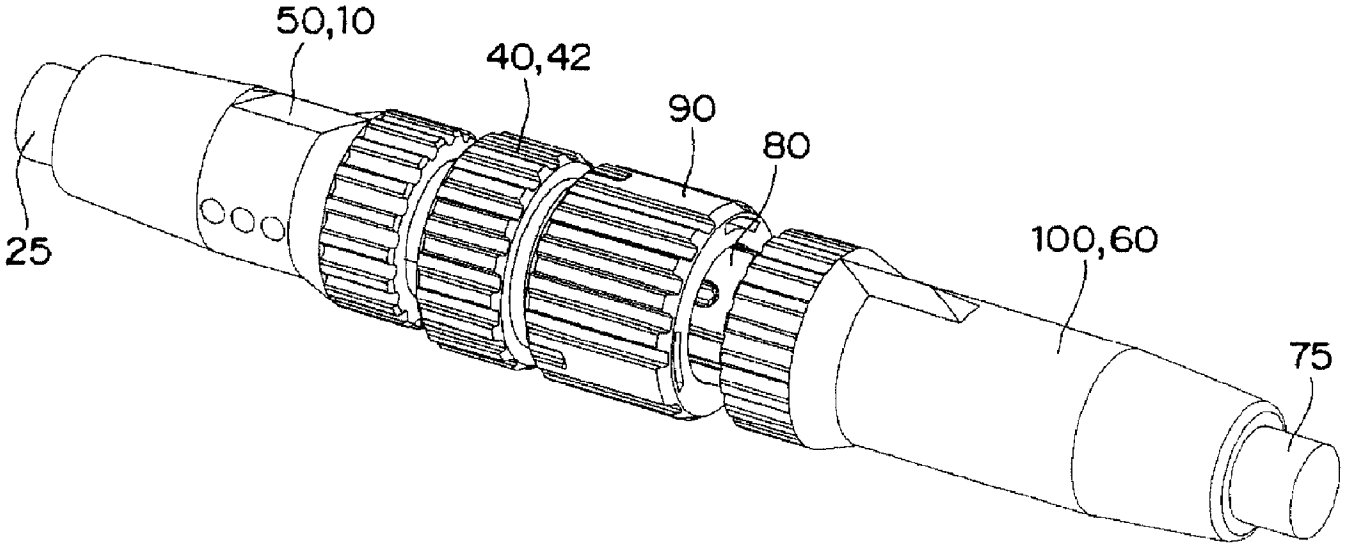
FIGS. 22A and 22B are a perspective view and a cross-sectional perspective view, respectively, showing a state before connection of the plug of the second embodiment and the socket of the first embodiment according to the present invention.
Figure 22B:
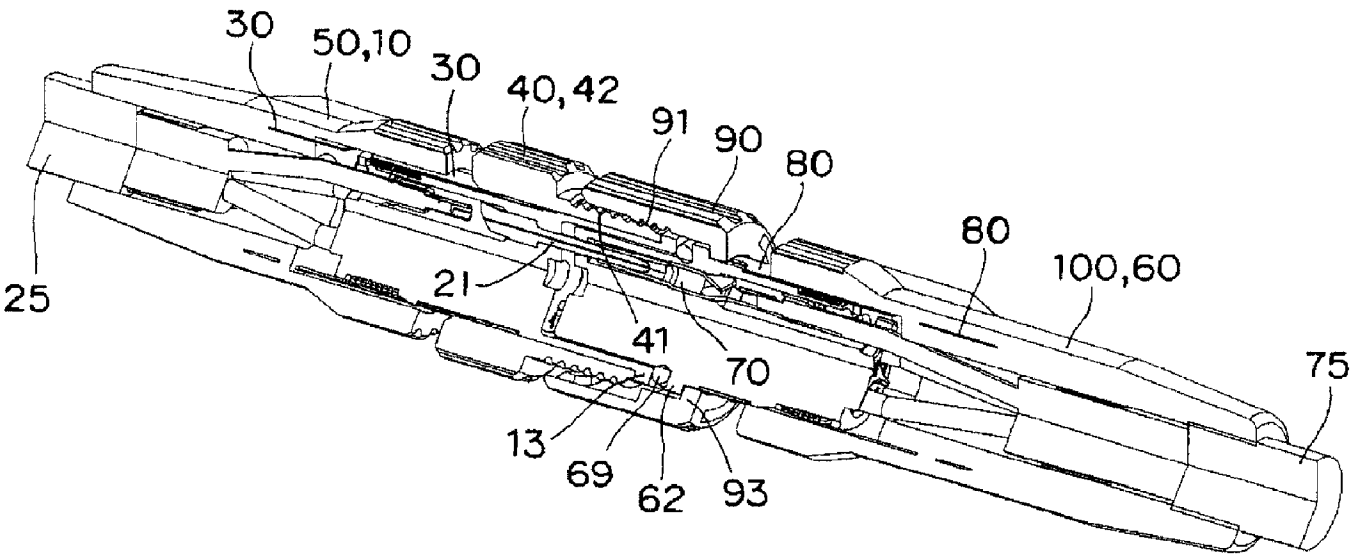
Figure 23E:
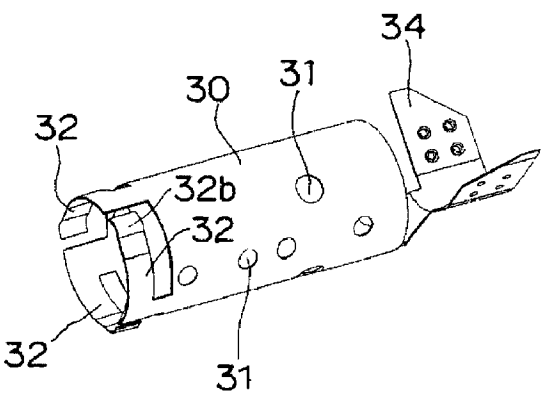
FIGS. 23A, 23B, 23C, 23D, 23E, and 23F are perspective views each showing variants of the shield member.
Figure 23C:
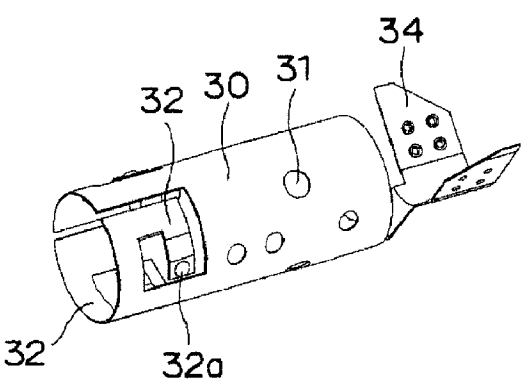
Figure 23A:
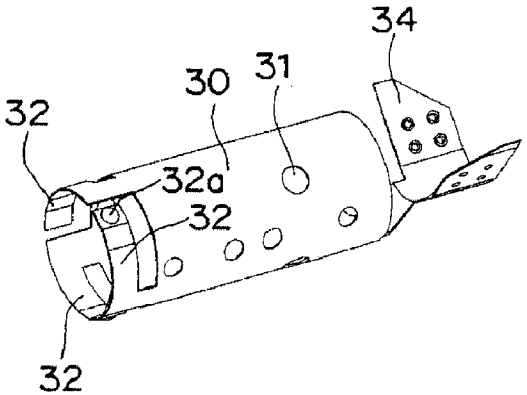
Figure 23F:
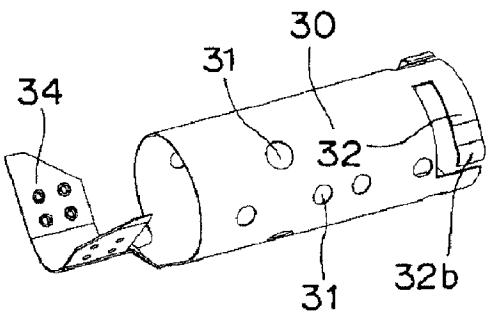
Figure 23D:
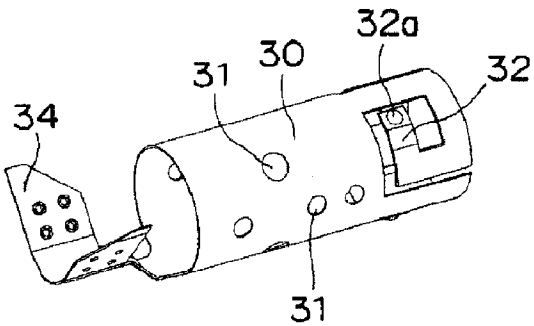
Figure 23B:
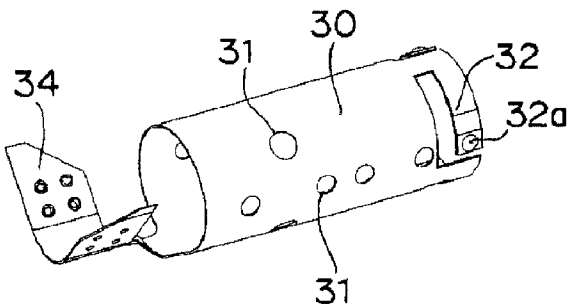
Figure 24E:
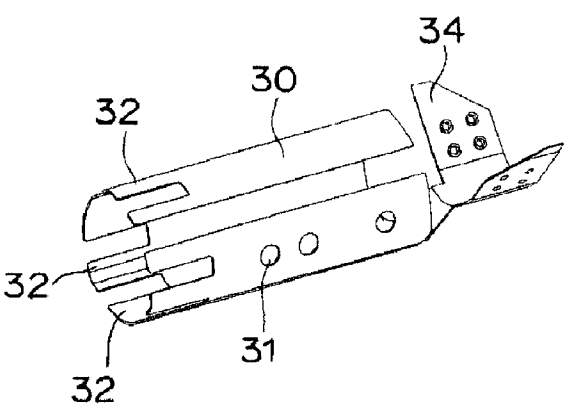
FIGS. 24A, 24B, 24C, 24D, 24E, and 24F are perspective views each showing other variants of the shield member.
Figure 24C:
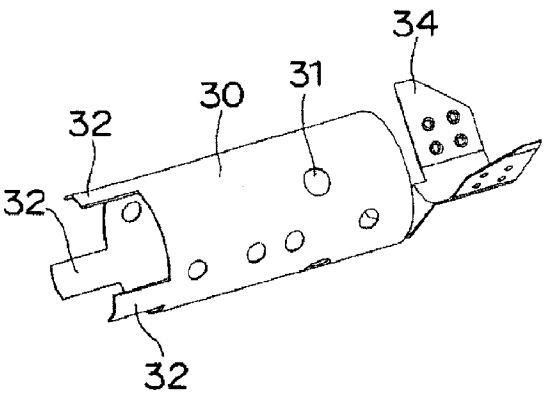
Figure 24A:
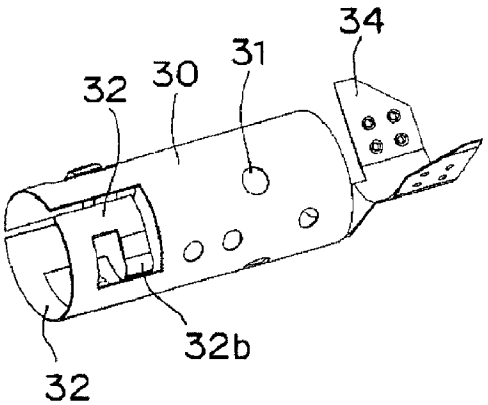
Figure 24F:
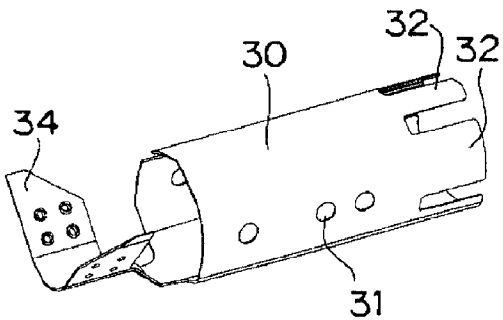
Figure 24D:
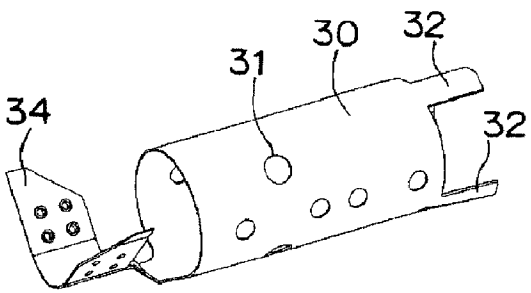
Figure 24B:
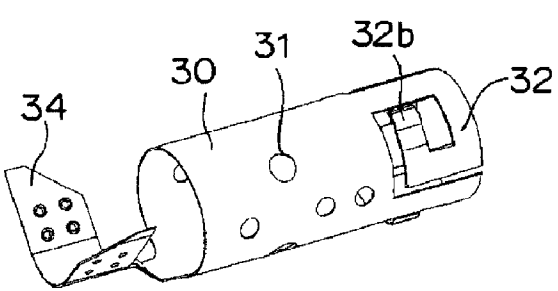
Figure 25A:
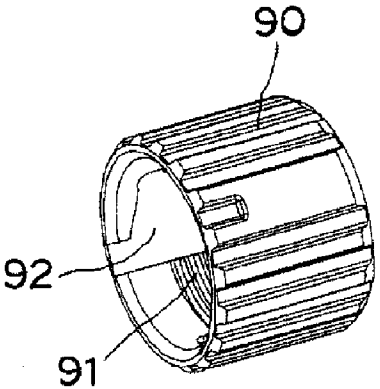
FIGS. 25A, 25B, 25C, 25D, 25E, and 25F are perspective views each showing variants of the socket holder.
Figure 25B:
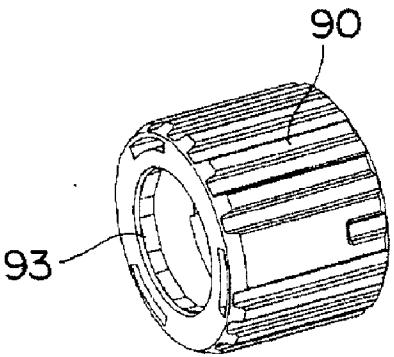
Figure 25C:
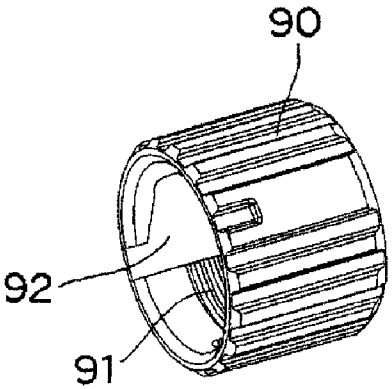
Figure 25D:
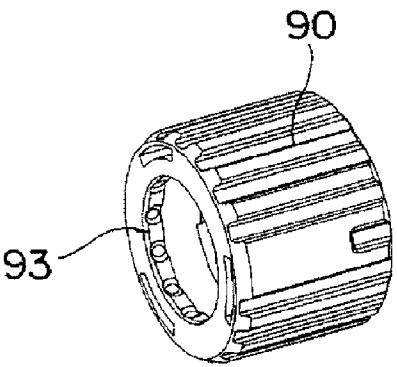
Figure 25E:
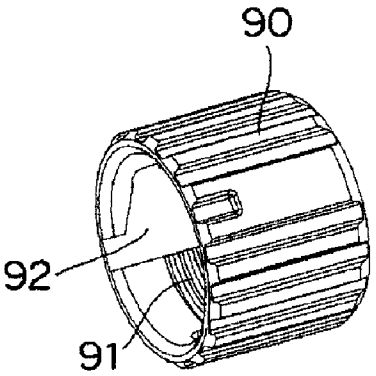
Figure 25F:
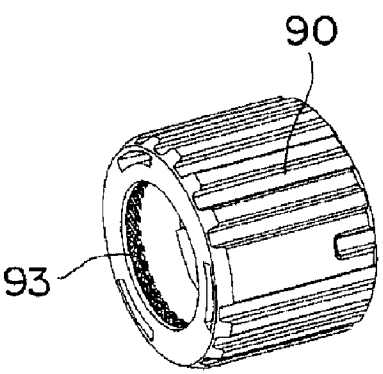
Figure 26A:
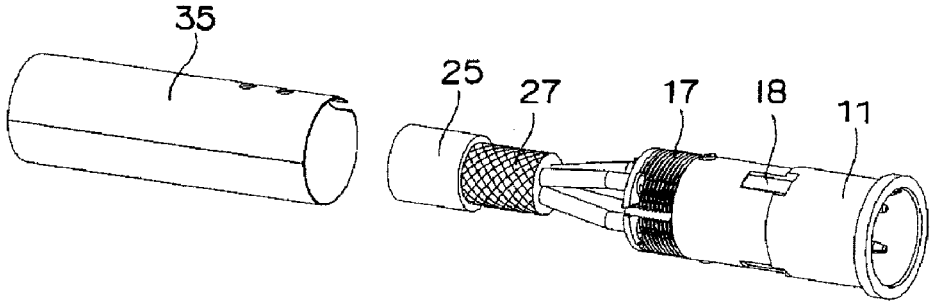
FIGS. 26A to 26E are perspective views each showing an assembly step of a third embodiment of the plug according to the present invention.
Figure 26B:
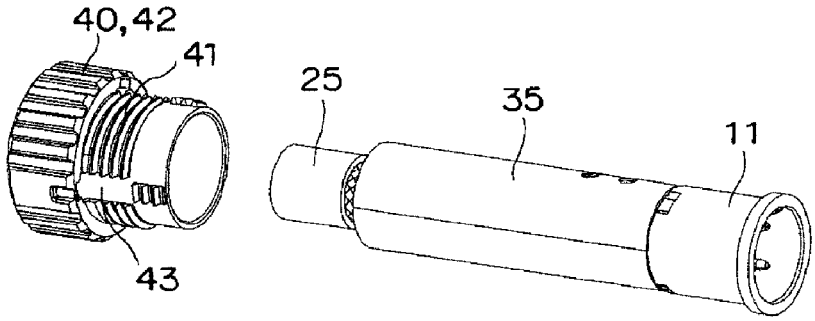
Figure 26C:
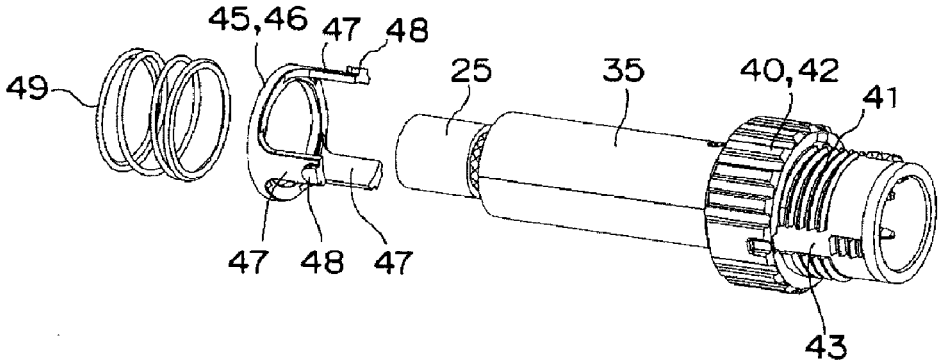
Figure 26D:
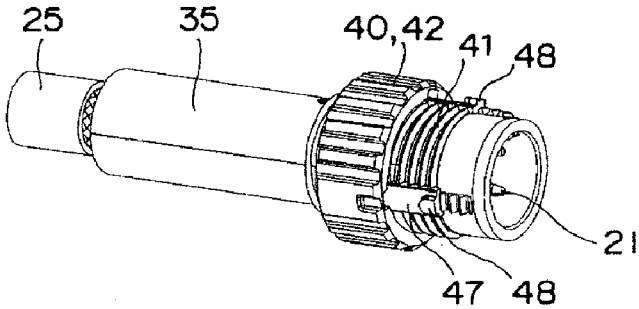
Figure 26E:
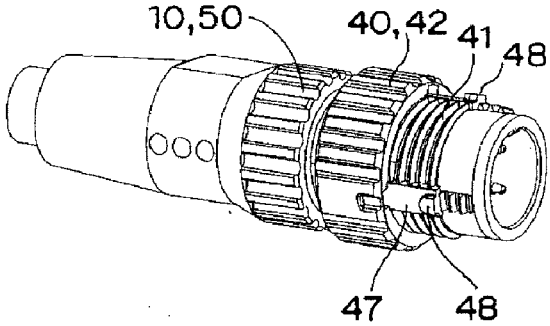
Figure 27A:
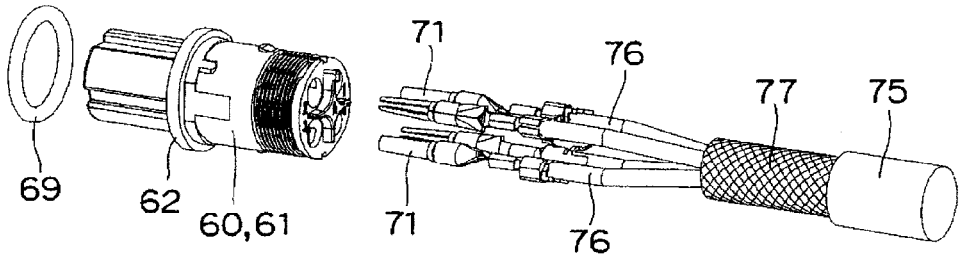
FIGS. 27A to 27E are perspective views each showing an assembly step of the third embodiment of the socket according to the present invention.
Figure 27B:
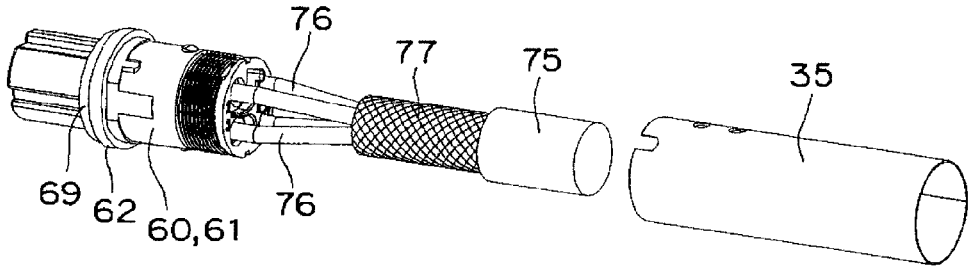
Figure 27C:
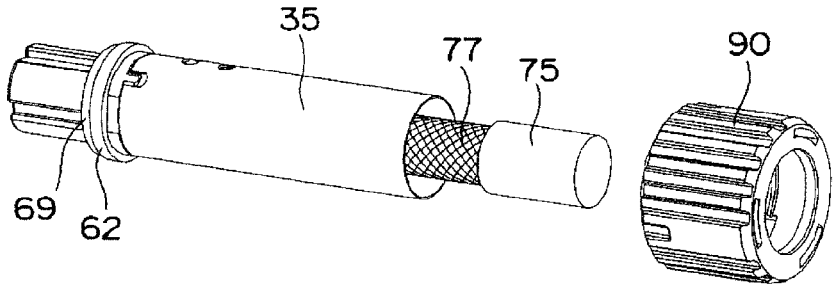
Figure 27D:
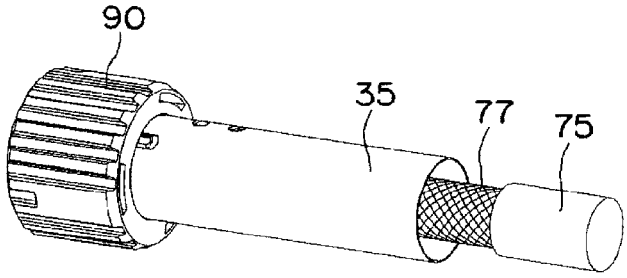
Figure 27E:
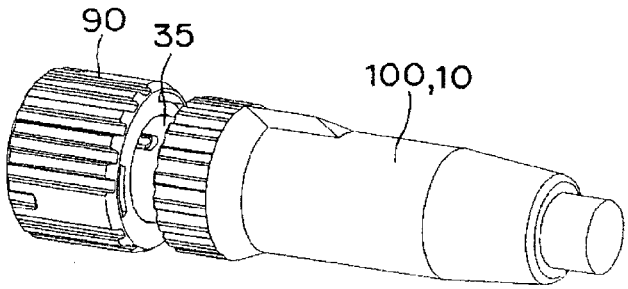
Figure 28C:
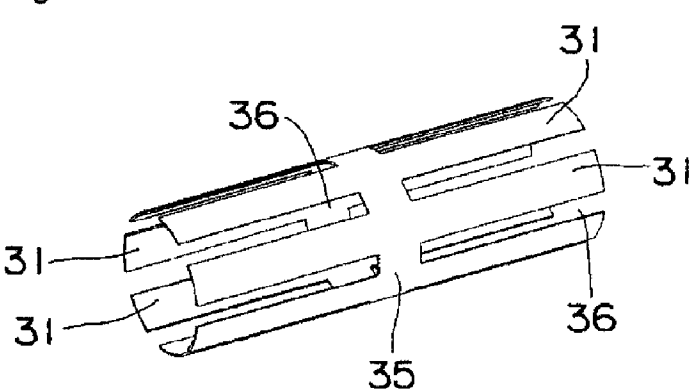
FIGS. 28A, 28B, 28C, and 28D are perspective views each showing other variants of the shield member.
Figure 28D:
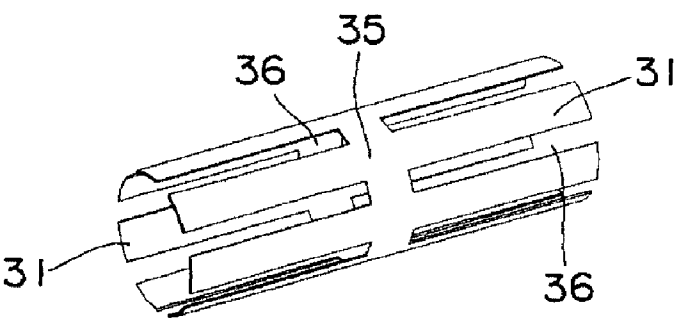
Figure 28A:
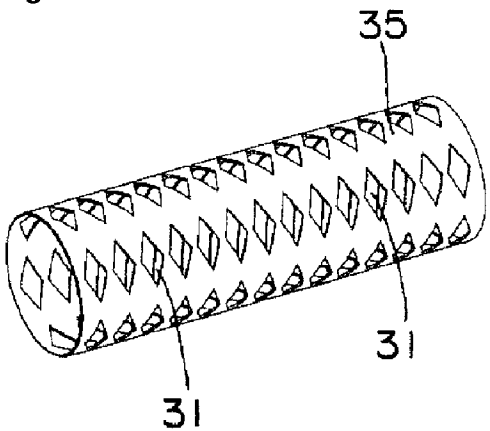
Figure 28B:
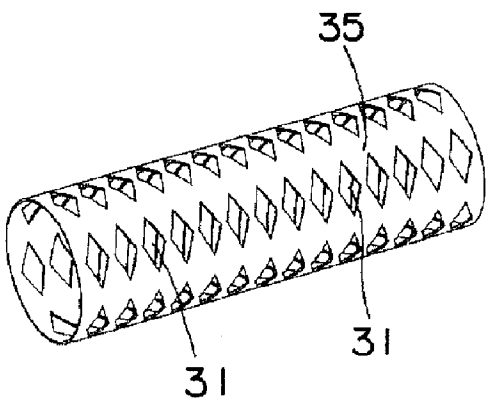

A fourth connection method is for connecting the screw-type plug 10 of the second embodiment and the bayonet-type socket 60 of the first embodiment, as shown in FIGS. 21 and 22.

When connecting the screw-type plug 10 and the bayonet-type socket 60, as shown in FIGS. 21A and 21B, the guide groove portion 65 arranged at the inserting portion 63 of the socket main body 61 is fitted into and positioned at the guide protrusion 14 arranged at the fit-in recessed site 12 of the plug main body 11, and then pushed in so that the pin 21 of the pin terminal 20 is inserted to and electrically connected to the socket portion 71 of the socket terminal 70. The male screw 41 of the plug holder 40 is screwed into the female screw 91 of the socket holder 90 and tightened to be in a locked state. The annular ribs 13, 62 compress and hold the O-ring 69 thereby ensuring high water proof property.

In the case of a connector not requiring an electromagnetic shield, the shield member does not necessarily need to be made of metal, and merely needs to be a reinforcement material, and furthermore, the caulking portion is not necessarily required. Thus, as shown in FIGS. 26 and 27, the reinforcement member 35 of a simple cylindrical shape with a through-hole may be formed.

As shown in FIGS. 28A to 28D, if a simple reinforcement member is provided, a number of rhombic through-holes 31 may be formed in the cylindrical reinforcement member 35, or a slit 36 may be adjacently arranged at a predetermined pitch along the axis center direction to cutout the elastic arm 32.

When attaching the socket holder to the socket main body, a slight play is preferably provided in the axis center direction with respect to the socket main body.

The connector according to the present invention has been described to have the socket and the plug directly electrically connected on the same axis center, but this is not the sole case, and application can be made to when connecting the electric cable to a socket fixed to an attachment plate in advance by way of the plug.

What is claimed is:

1. A connector comprising:

a plug connected to a first electric cable, and comprising a pin terminal and a plug holder;

a socket connected to a second electric cable, and comprising a socket terminal and a socket holder; and a first tubular shield member and a second tubular shield member, wherein the pin terminal of the plug is press-fitted and electrically connected to the socket terminal of the socket, wherein the plug holder is connected to the socket holder, wherein one distal end of the first tubular shield member is electrically connected to a shield wire of the first electric cable, wherein an elastic arm formed at an opening edge at the other distal end of the first tubular shield member is contacted to a conductive inner peripheral surface of the plug holder, wherein one distal end of the second tubular shield member is electrically connected to a shield wire of the second electric cable, and wherein an elastic arm formed at an opening edge at the other distal end of the second tubular shield member is contacted to a conductive inner peripheral surface of the socket holder.

2. The connector according to claim 1, wherein a portion of the inner peripheral surface of the socket holder to which the elastic arm of the second tubular shield member contacts has a surface shape that produces a click feeling.

3. The connector according to claim 1, wherein at least one straight elastic arm extends substantially parallel along an axis center direction at the opening edge at the other distal end of the second tubular shield member.

4. The connector according to claim 1, wherein the elastic arm formed at the opening edge at the other distal end of the second tubular shield member has a substantially L-shape.

5. The connector according to claim 1, wherein the elastic arm formed at the opening edge at the other distal end of the second tubular shield member has a discontinuous square frame shape with one portion cutout.

6. The connector according to claim 1, wherein the second tubular shield member has a joint for electrically connecting to the shield wire of the second electric cable extending from the opening edge at the one distal end.

7. The connector according to claim 6, wherein the joint of the second tubular shield member is a caulking portion.

8. The connector according to claim 2, wherein at least one straight elastic arm extends substantially parallel along an axis center direction at the opening edge at the other distal end of the second tubular shield member.

9. The connector according to claim 2, wherein the elastic arm formed at the opening edge at the other distal end of the second tubular shield member has a substantially L-shape.

10. The connector according to claim 2, wherein the elastic arm formed at the opening edge at the other distal end of the second tubular shield member has a discontinuous square frame shape with one portion cutout.

11. The connector according to claim 1, wherein a portion of the inner peripheral surface of the socket holder to which the elastic arm of the first tubular shield member contacts has a surface shape that produces a click feeling.

12. The connector according to claim 1, wherein at least one straight elastic arm extends substantially parallel along an axis center direction at the opening edge at the other distal end of the first tubular shield member.

13. The connector according to claim 1, wherein the elastic arm formed at the opening edge at the other distal end of the first tubular shield member has a substantially L-shape.

14. The connector according to claim 1, wherein the elastic arm formed at the opening edge at the other distal end of the second tubular shield member has a discontinuous square frame shape with one portion cutout.

15. The connector according to claim 1, wherein the first tubular shield member has a joint for electrically connecting to the shield wire of the first electric cable extending from the opening edge at the one distal end.

16. The connector according to claim 15, wherein the joint of the first tubular shield member is a caulking portion.

17. The connector according to claim 11, wherein at least one straight elastic arm extends substantially parallel along an axis center direction at the opening edge at the other distal end of the first tubular shield member.

18. The connector according to claim 11, wherein the elastic arm formed at the opening edge at the other distal end of the first tubular shield member has a substantially L-shape.

19. The connector according to claim 11, wherein the elastic arm formed at the opening edge at the other distal end of the first tubular shield member has a discontinuous square frame shape with one portion cutout.

* * * * *